US010336500B2

(12) United States Patent
Burke

(10) Patent No.: US 10,336,500 B2
(45) Date of Patent: Jul. 2, 2019

(54) TRAY FOR HOLDING A FOOD PRODUCT

(71) Applicant: Graphic Packaging International, LLC, Atlanta, GA (US)

(72) Inventor: Bradley J. Burke, Wheaton, IL (US)

(73) Assignee: Graphic Packaging International, LLC, Atlanta, GA (US)

( * ) Notice: Subject to any disclaimer, the term of this patent is extended or adjusted under 35 U.S.C. 154(b) by 838 days.

(21) Appl. No.: 14/933,316

(22) Filed: Nov. 5, 2015

(65) Prior Publication Data

US 2016/0130027 A1 May 12, 2016

Related U.S. Application Data

(60) Provisional application No. 62/123,118, filed on Nov. 7, 2014, provisional application No. 62/125,753, filed on Jan. 30, 2015.

(51) Int. Cl.

| | |
|---|---|
| ***B65D 5/00*** | (2006.01) |
| ***B65D 5/20*** | (2006.01) |
| ***B65D 5/24*** | (2006.01) |
| ***B65D 5/42*** | (2006.01) |
| ***B65D 5/28*** | (2006.01) |

(52) U.S. Cl.

CPC ..... *B65D 5/003* (2013.01); *B65D 5/008* (2013.01); *B65D 5/2047* (2013.01); *B65D 5/241* (2013.01); *B65D 5/28* (2013.01); *B65D 5/4266* (2013.01)

(58) Field of Classification Search

CPC ..... B65D 5/003; B65D 5/008; B65D 5/2047; B65D 5/241; B65D 5/28; B65D 5/4266

See application file for complete search history.

(56) References Cited

U.S. PATENT DOCUMENTS

| | | | |
|---|---|---|---|
| 622,921 | A | 4/1899 | Fuller |
| 667,634 | A | 2/1901 | Schmidt |
| 1,894,209 | A | 1/1933 | Wikstrom |
| 2,016,754 | A | 10/1935 | Perkit |
| 2,028,276 | A | 1/1936 | Evans |
| 2,037,502 | A | 4/1936 | Cox |
| 2,043,104 | A | 6/1936 | Clancy |

(Continued)

FOREIGN PATENT DOCUMENTS

| | | |
|---|---|---|
| EP | 0 270 838 | 6/1988 |
| EP | 1 481 922 | 12/2004 |

(Continued)

OTHER PUBLICATIONS

International Search Report and Written Opinion for PCT/US2015/059167 dated Feb. 26, 2016.

*Primary Examiner* — Corey N Skurdal

(74) *Attorney, Agent, or Firm* — Womble Bond Dickinson (US) LLP

(57) ABSTRACT

A tray for holding a food product. The tray includes a plurality of panels that extend at least partially around an interior of the tray. The plurality of panels includes a bottom panel, a side panel foldably connected to the bottom panel, and an end panel foldably connected to the bottom panel. The tray includes a reinforcing structure having a first reinforcement panel foldably connected to at least one panel of the plurality of panels, and a second reinforcement panel foldably connected to the first reinforcement panel. The tray further includes a gusset panel foldably connected to the side panel. The gusset panel and the end panel at least partially overlapping one another.

47 Claims, 20 Drawing Sheets

(56) References Cited

U.S. PATENT DOCUMENTS

| | | | |
|---|---|---|---|
| 2,232,088 | A | 2/1941 | Waters |
| 2,321,848 | A | 6/1943 | O'Reilly |
| 2,740,576 | A | 4/1956 | Franck |
| 2,800,893 | A | 7/1957 | Norman et al. |
| 2,836,339 | A | 5/1958 | Pringle |
| 2,858,630 | A | 11/1958 | Gorman |
| 2,944,721 | A | 7/1960 | Choate |
| 3,276,660 | A | 10/1966 | Vesak |
| 3,300,117 | A | 1/1967 | Kossnar |
| 3,366,306 | A | 1/1968 | Kotowick |
| 3,425,543 | A | 2/1969 | Harvey |
| 3,447,672 | A | 6/1969 | Bailey et al. |
| 3,478,950 | A | 11/1969 | Stevens |
| 3,515,331 | A | 6/1970 | Guthrie, Sr. |
| 3,516,594 | A | 6/1970 | Stenzel |
| 3,516,595 | A | 6/1970 | Bailey |
| 3,630,430 | A | 12/1971 | Struble |
| 3,637,130 | A | 1/1972 | Farquhar |
| 3,767,108 | A | 10/1973 | Arneson |
| 3,833,113 | A | 9/1974 | Osier |
| 3,845,897 | A | 11/1974 | Buttery et al. |
| 3,876,131 | A | 4/1975 | Tolaas |
| 3,877,632 | A | 4/1975 | Steel |
| 3,912,331 | A | 10/1975 | Turner et al. |
| 3,927,823 | A | 12/1975 | Persson |
| 4,014,496 | A | 3/1977 | Christensson |
| 4,049,188 | A | 9/1977 | Persson |
| 4,054,241 | A | 10/1977 | Meyers et al. |
| 4,079,853 | A | 3/1978 | Casutt |
| 4,109,848 | A | 8/1978 | Kipp et al. |
| 4,124,160 | A | 11/1978 | Meyers et al. |
| 4,126,265 | A | 11/1978 | Holmes |
| 4,166,567 | A | 9/1979 | Beach, Jr. et al. |
| 4,185,764 | A | 1/1980 | Cote |
| 4,199,097 | A | 4/1980 | Christensson |
| 4,205,775 | A | 6/1980 | Swan |
| 4,227,640 | A | 10/1980 | Roccaforte |
| 4,244,472 | A | 1/1981 | Brown |
| 4,267,955 | A | 5/1981 | Struble |
| 4,277,506 | A | 7/1981 | Austin |
| 4,283,427 | A | 8/1981 | Winters et al. |
| 4,305,543 | A | 12/1981 | Lai |
| 4,410,129 | A | 10/1983 | Wischusen, III |
| 4,418,861 | A | 12/1983 | McFarland et al. |
| 4,432,489 | A | 2/1984 | Cote |
| 4,502,623 | A | 3/1985 | Moore et al. |
| 4,607,785 | A | 8/1986 | Croley |
| 4,676,429 | A | 6/1987 | Crowe et al. |
| D290,813 | S | 7/1987 | Forbes, Jr. |
| 4,682,727 | A | 7/1987 | Stoll |
| 4,765,534 | A | 8/1988 | Zion et al. |
| 4,775,771 | A | 10/1988 | Pawlowski et al. |
| 4,792,084 | A | 12/1988 | Dreeszen |
| 4,801,774 | A | 1/1989 | Hart |
| 4,836,439 | A | 6/1989 | Hart |
| 4,865,921 | A | 9/1989 | Hollenberg et al. |
| 4,871,111 | A | 10/1989 | Mode |
| 4,890,439 | A | 1/1990 | Smart |
| 4,915,235 | A | 4/1990 | Roosa |
| 4,919,267 | A | 4/1990 | Stoll |
| 4,936,935 | A | 6/1990 | Beckett |
| 4,943,456 | A | 7/1990 | Pollart et al. |
| 4,963,424 | A | 10/1990 | Beckett |
| 5,002,826 | A | 3/1991 | Pollart et al. |
| 5,039,364 | A | 8/1991 | Beckett et al. |
| 5,049,710 | A | 9/1991 | Prosise et al. |
| 5,077,455 | A | 12/1991 | Peleg et al. |
| 5,117,078 | A | 5/1992 | Beckett |
| 5,118,747 | A | 6/1992 | Pollart et al. |
| 5,211,330 | A | 5/1993 | Frey |
| 5,213,902 | A | 5/1993 | Beckett |
| 5,221,419 | A | 6/1993 | Beckett |
| 5,232,149 | A | 8/1993 | Stoll |
| 5,247,149 | A | 9/1993 | Peleg |
| 5,260,537 | A | 11/1993 | Beckett |
| 5,266,386 | A | 11/1993 | Beckett |
| 5,294,765 | A | 3/1994 | Archibald et al. |
| 5,326,021 | A | 7/1994 | Farrell |
| RE34,683 | E | 8/1994 | Maynard et al. |
| 5,338,921 | A | 8/1994 | Maheux et al. |
| 5,340,436 | A | 8/1994 | Beckett |
| 5,351,879 | A | 10/1994 | Liu et al. |
| 5,354,973 | A | 10/1994 | Beckett |
| 5,410,135 | A | 4/1995 | Pollart et al. |
| 5,412,187 | A | 5/1995 | Walters et al. |
| 5,424,517 | A | 6/1995 | Habeger, Jr. et al. |
| 5,519,195 | A | 5/1996 | Keefer et al. |
| 5,520,322 | A | 5/1996 | Conviser |
| 5,530,231 | A | 6/1996 | Walters et al. |
| 5,535,942 | A | 7/1996 | Vilona |
| 5,628,921 | A | 5/1997 | Beckett |
| 5,672,407 | A | 9/1997 | Beckett |
| 5,718,368 | A | 2/1998 | Rench et al. |
| 5,720,429 | A | 2/1998 | Cordle |
| 5,726,426 | A | 3/1998 | Davis et al. |
| 5,759,422 | A | 6/1998 | Schmelzer et al. |
| 5,762,225 | A | 6/1998 | Byrd |
| 5,800,724 | A | 9/1998 | Habeger et al. |
| 5,816,485 | A | 10/1998 | Bernstein |
| 5,948,308 | A | 9/1999 | Wischusen, III |
| 5,961,035 | A | 10/1999 | Correll |
| 6,019,276 | A | 2/2000 | Auclair |
| 6,050,482 | A | 4/2000 | Cai |
| 6,102,281 | A | 8/2000 | Lafferty et al. |
| 6,114,679 | A | 9/2000 | Lai et al. |
| 6,137,099 | A | 10/2000 | Hamblin |
| 6,150,646 | A | 11/2000 | Lai et al. |
| 6,170,740 | B1 | 1/2001 | Clark |
| D437,557 | S | 2/2001 | Ingelin et al. |
| 6,182,890 | B1 | 2/2001 | Sattler et al. |
| 6,204,492 | B1 | 3/2001 | Zeng et al. |
| 6,251,451 | B1 | 6/2001 | Zeng |
| 6,359,272 | B1 | 3/2002 | Sadek et al. |
| 6,371,363 | B1 | 4/2002 | Franklin et al. |
| 6,371,364 | B1 | 4/2002 | Maillot |
| 6,414,290 | B1 | 7/2002 | Cole et al. |
| 6,433,322 | B2 | 8/2002 | Zeng et al. |
| 6,455,827 | B2 | 9/2002 | Zeng |
| 6,513,704 | B1 | 2/2003 | Perot |
| 6,552,315 | B2 | 4/2003 | Zeng et al. |
| 6,561,414 | B1 | 5/2003 | Cai |
| 6,588,652 | B2 | 7/2003 | Cai |
| 6,677,563 | B2 | 1/2004 | Lai |
| 6,717,121 | B2 | 4/2004 | Zeng et al. |
| 6,719,190 | B2 | 4/2004 | Yocum |
| 6,765,182 | B2 | 7/2004 | Cole et al. |
| 6,808,105 | B2 | 10/2004 | Lee |
| 7,007,838 | B1 | 3/2006 | Bostick, II |
| 7,017,797 | B2 | 3/2006 | Goglio |
| 7,019,271 | B2 | 3/2006 | Wnek et al. |
| 7,140,532 | B2 | 11/2006 | Holt et al. |
| 7,219,828 | B2 | 5/2007 | Lombardo |
| 7,232,055 | B1 | 6/2007 | Lim |
| 7,273,162 | B2 | 9/2007 | Baker |
| 7,323,669 | B2 | 1/2008 | Robison et al. |
| 7,328,833 | B1 | 2/2008 | Wiley |
| 7,351,942 | B2 | 4/2008 | Wnek et al. |
| 7,365,292 | B2 | 4/2008 | Cole et al. |
| 7,473,875 | B2 | 1/2009 | Fitzwater |
| 7,514,659 | B2 | 4/2009 | Lafferty |
| 7,541,562 | B2 | 6/2009 | Cole et al. |
| 7,648,031 | B2 | 1/2010 | Kari |
| 7,648,059 | B2 | 1/2010 | Pavlu, Jr. et al. |
| 7,667,167 | B2 | 2/2010 | Fitzwater |
| 7,748,536 | B2 | 7/2010 | Cassese et al. |
| 7,762,394 | B2 | 7/2010 | Bradford et al. |
| 7,793,821 | B2 | 9/2010 | Oliveira |
| 7,798,327 | B1 | 9/2010 | Berkani et al. |
| 7,824,719 | B2 | 11/2010 | Cole et al. |
| 7,893,389 | B2 | 2/2011 | Fitzwater |
| 7,975,871 | B2 | 7/2011 | Wnek et al. |
| 7,982,167 | B2 | 7/2011 | Fitzwater |
| 7,982,349 | B2 | 7/2011 | Popov et al. |
| 8,013,280 | B2 | 9/2011 | Robison et al. |

(56) References Cited

U.S. PATENT DOCUMENTS

| | | | |
|---|---|---|---|
| 8,063,344 | B2 | 11/2011 | Cole et al. |
| 8,087,570 | B2 | 1/2012 | Ho Fung |
| 8,106,339 | B2 | 1/2012 | Robbins et al. |
| 8,158,914 | B2 | 4/2012 | Wnek et al. |
| 8,183,506 | B2 | 5/2012 | Fitzwater |
| 8,186,570 | B2 | 5/2012 | Learn |
| 8,252,217 | B2 | 8/2012 | Wnek et al. |
| 8,309,896 | B2 | 11/2012 | Fitzwater |
| 8,492,690 | B1 | 7/2013 | Watkins |
| 8,534,536 | B2 | 9/2013 | Mueller et al. |
| 9,078,296 | B2 | 7/2015 | Fitzwater |
| 9,113,648 | B2 | 8/2015 | Burke |
| 9,402,491 | B1 | 8/2016 | Debernardi |
| 2001/0032843 | A1 | 10/2001 | Aronsson et al. |
| 2002/0084319 | A1 | 7/2002 | Yocum |
| 2003/0006273 | A1 | 1/2003 | Tsern et al. |
| 2003/0226881 | A1 | 12/2003 | Liou |
| 2004/0232034 | A1 | 11/2004 | Lebras |
| 2004/0234653 | A1 | 11/2004 | Cogley et al. |
| 2004/0238534 | A1 | 12/2004 | Mast |
| 2005/0082355 | A1 | 4/2005 | Beutler |
| 2005/0184066 | A1 | 8/2005 | Brooks et al. |
| 2005/0194286 | A1 | 9/2005 | Ilyayeva et al. |
| 2005/0205565 | A1 | 9/2005 | Cole et al. |
| 2006/0006215 | A1 | 1/2006 | Chen |
| 2006/0049190 | A1 | 3/2006 | Middleton et al. |
| 2006/0096978 | A1 | 5/2006 | Lafferty et al. |
| 2006/0113300 | A1 | 6/2006 | Wnek et al. |
| 2006/0180644 | A1 | 8/2006 | Baker |
| 2006/0278521 | A1 | 12/2006 | Stowell |
| 2007/0056962 | A1 | 3/2007 | Hopkins, Sr. et al. |
| 2007/0102424 | A1 | 5/2007 | Keefe |
| 2007/0131744 | A1 | 6/2007 | Fitzwater |
| 2007/0131745 | A1 | 6/2007 | Fitzwater |
| 2007/0215611 | A1 | 9/2007 | O'Hagan et al. |
| 2007/0251942 | A1 | 11/2007 | Cole et al. |
| 2007/0251943 | A1 | 11/2007 | Wnek et al. |
| 2007/0262487 | A1 | 11/2007 | O'Hagan et al. |
| 2007/0275130 | A1 | 11/2007 | Cole et al. |
| 2008/0000897 | A1 | 1/2008 | Robbins et al. |
| 2008/0023469 | A1 | 1/2008 | Fitzwater |
| 2008/0035634 | A1 | 2/2008 | Zeng et al. |
| 2008/0047958 | A1 | 2/2008 | Cole et al. |
| 2008/0078759 | A1 | 4/2008 | Wnek et al. |
| 2008/0081095 | A1 | 4/2008 | Cole et al. |
| 2008/0110966 | A1 | 5/2008 | Yocum |
| 2009/0072015 | A1 | 3/2009 | Drew et al. |
| 2009/0090708 | A1 | 4/2009 | Requena et al. |
| 2009/0218338 | A1 | 9/2009 | Futzwater |
| 2010/0025393 | A1 | 2/2010 | Talpaert |
| 2010/0038359 | A1 | 2/2010 | Laubhan et al. |
| 2010/0051675 | A1 | 3/2010 | Sweet |
| 2010/0065556 | A1 | 3/2010 | Cole |
| 2010/0065621 | A1 | 3/2010 | Quaintance |
| 2010/0072197 | A1 | 3/2010 | Neff et al. |
| 2010/0102111 | A1 | 4/2010 | Learn |
| 2010/0122999 | A1 | 5/2010 | Brand |
| 2010/0193509 | A1 | 8/2010 | Fitzwater |
| 2010/0264135 | A1 | 10/2010 | Cole |
| 2011/0024413 | A1 | 2/2011 | Cole |
| 2011/0089227 | A1 | 4/2011 | Kaltman et al. |
| 2011/0114715 | A1 | 5/2011 | House |
| 2011/0132903 | A1 | 6/2011 | Cole |
| 2011/0233266 | A1 | 9/2011 | Pezzoli |
| 2012/0228370 | A1 | 9/2012 | Faulon et al. |
| 2013/0087607 | A1 | 4/2013 | Learn |
| 2013/0299566 | A1 | 11/2013 | Sylvester |
| 2014/0374953 | A1 | 12/2014 | Middleton |
| 2015/0375468 | A1 | 12/2015 | Wnek |

FOREIGN PATENT DOCUMENTS

| | | |
|---|---|---|
| EP | 1 364 558 | 3/2005 |
| EP | 2 240 385 | 6/2008 |
| EP | 2 605 974 | 3/2014 |
| EP | 2 974 973 | 1/2016 |
| FR | 2 867 346 | 9/2005 |
| JP | 4-253670 | 9/1992 |
| JP | 6-293334 | 10/1994 |
| JP | 7-040968 | 2/1995 |
| JP | 2001-247122 | 2/2001 |
| KR | 10-1363935 B1 | 2/2014 |
| WO | WO 94/05563 | 3/1994 |
| WO | WO 02/060223 | 8/2002 |
| WO | WO 03/066435 | 8/2003 |
| WO | WO 2005/077783 | 8/2005 |
| WO | WO 2006/076501 | 7/2006 |
| WO | WO 2007/127235 | 11/2007 |
| WO | WO 2007/127371 | 11/2007 |
| WO | WO 2007/133659 | 11/2007 |
| WO | WO 2007/136839 | 11/2007 |
| WO | WO 2009/006096 | 1/2009 |
| WO | WO 2012/024206 | 2/2012 |

TRAY FOR HOLDING A FOOD PRODUCT

CROSS-REFERENCE TO RELATED APPLICATION

This application claims the benefit of U.S. Provisional Patent Application No. 62/123,118, filed Nov. 7, 2014 and U.S. Provisional Patent Application No. 62/125,753, filed Jan. 30, 2015.

INCORPORATION BY REFERENCE

The disclosure of U.S. Provisional Patent Application No. 62/123,118, which was filed on Nov. 7, 2014, and U.S. Provisional Patent Application No. 62/125,753, which was filed on Jan. 30, 2015, are hereby incorporated by reference for all purposes as if presented herein in their entirety

BACKGROUND OF THE DISCLOSURE

The present disclosure generally relates to packages for holding and displaying food. More specifically, the present disclosure relates to trays having reinforcement features,

SUMMARY OF THE DISCLOSURE

In one aspect, the disclosure is generally directed to a tray for holding a food product. The tray includes a plurality of panels that extend at least partially around an interior of the tray. The plurality of panels includes a bottom panel, a side panel foldably connected to the bottom panel, and an end panel foldably connected to the bottom panel. The tray includes a reinforcing structure having a first reinforcement panel foldably connected to at least one panel of the plurality of panels, and a second reinforcement panel foldably connected to the first reinforcement panel. The tray further includes a gusset panel foldably connected to the side panel. The gusset panel and the end panel at least partially overlapping one another.

In another aspect, the disclosure is generally directed to a tray blank for forming a tray for holding a food product. The blank includes a plurality of panels comprising a bottom panel, a side panel foldably connected to the bottom panel, and an end panel foldably connected to the bottom panel. The blank includes reinforcing structure features comprising a first reinforcement panel foldably connected to at least one panel of the plurality of panels, and a second reinforcement panel foldably connected to the first reinforcement panel. The blank further includes a gusset panel foldably connected to the side panel, the gusset panel and the end panel being for at least partially overlapping one another when the tray is formed from the blank.

In another aspect, the disclosure is generally directed to a method of forming a tray. The method comprises obtaining a blank comprising a plurality of panels, reinforcing structure features, and a gusset panel foldably connected to the side panel. The plurality of panels includes a bottom panel, a side panel foldably connected to the bottom panel, and an end panel foldably connected to the bottom panel. The reinforcing structure features include a first reinforcement panel foldably connected to at least one panel of the plurality of panels and a second reinforcement panel foldably connected to the first reinforcement panel. The method comprises at least partially forming an interior of the tray by positioning the side panel and the end panel with respect to the bottom panel. The method further includes positioning the gusset panel and the end panel to at least partially overlap one another.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The package of the present disclosure can be useful in containing a food product such as any suitable type of food product that can be wrapped or sealed and stacked or placed on display. For example, the food product could include vegetables, deli foods, or raw food products. Some suitable food products could comprise sliced meat or cheese, raw meat, or any other suitable food product. Further, the package of the present disclosure can be used for color coding, providing brand and product information, and providing value-added features such as recipes and coupons. It is understood that food products other than the food products listed herein may be contained in the package. Further, food products contained in this package may be generally triangular, round, square, rectangular, irregular, amorphous, or any other shape. In this specification, the terms "lower," "bottom," "upper," and "top" indicate orientations determined in relation to fully erected and upright packages.

Figure 1:
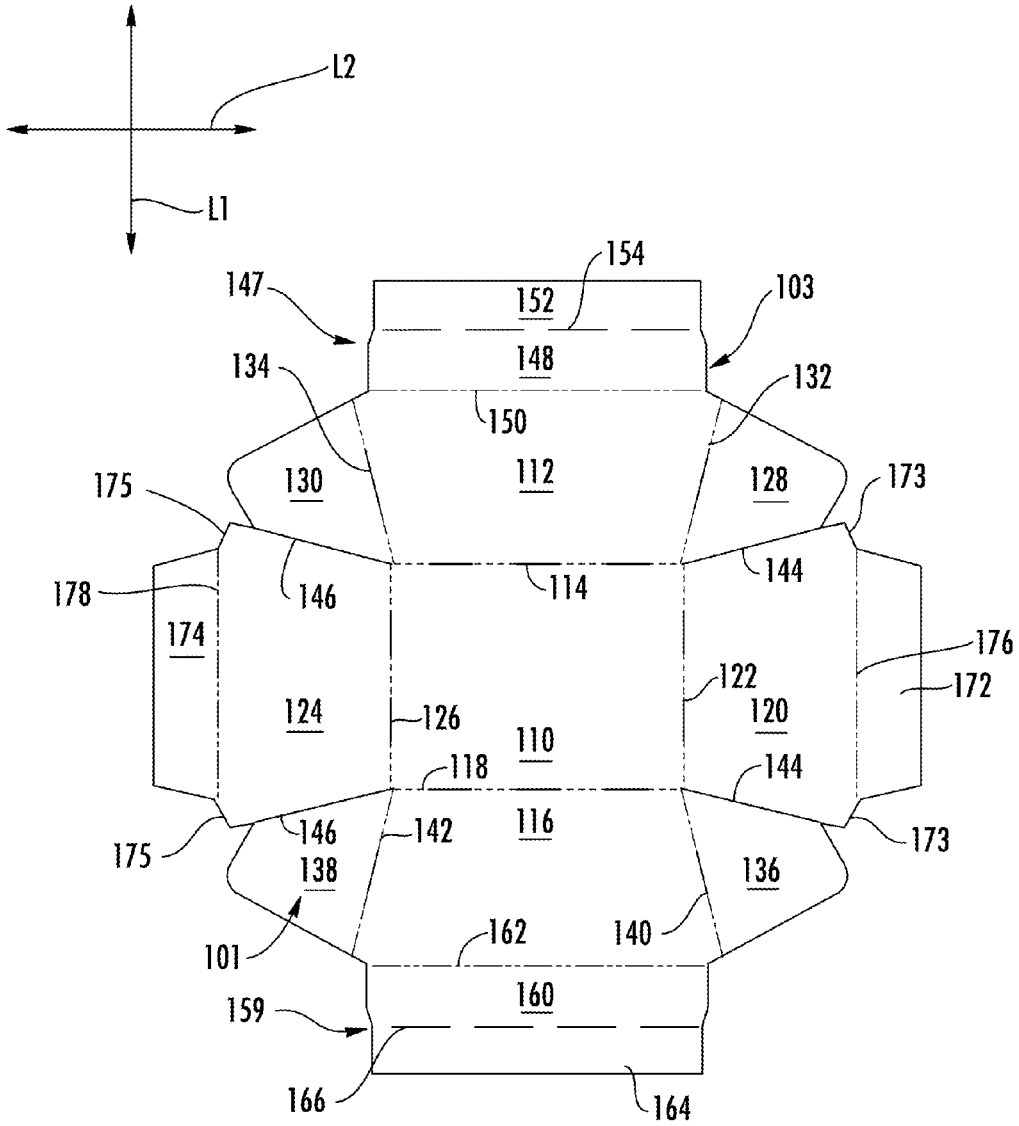
FIG. 1 is an interior plan view of a blank used to form a tray in accordance with a first embodiment of the disclosure.
Figure 2:
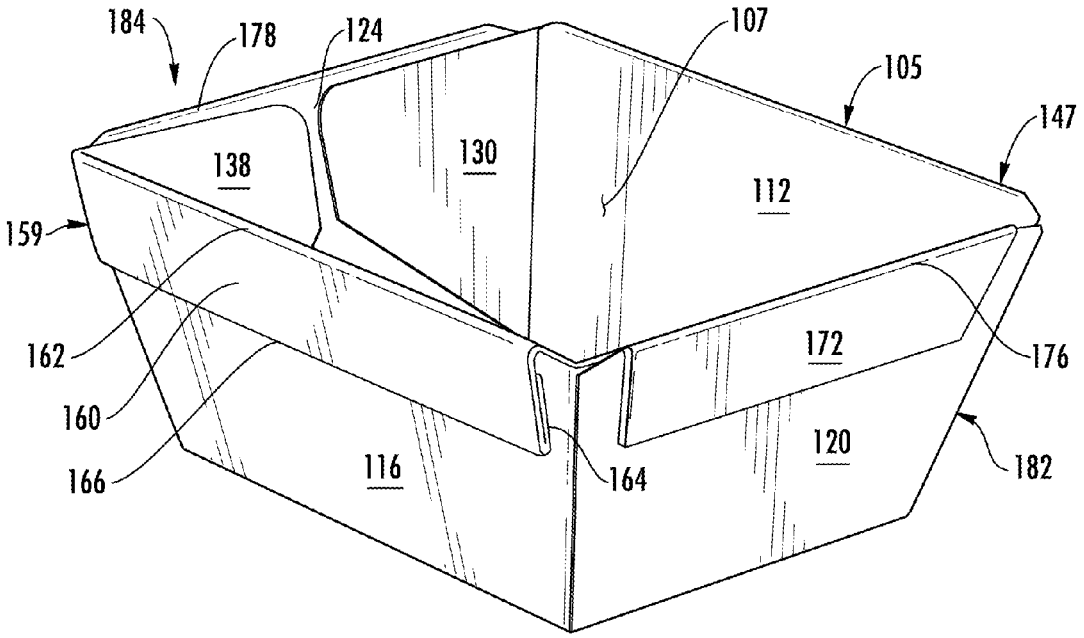
FIG. 2 is a perspective view of the tray formed from the blank of FIG. 1 according to the first embodiment of the disclosure.

FIG. 1 is a plan view of an interior side 101 of a tray blank, generally indicated at 103, used to form a tray 105, with an interior 107 (FIGS. 2 and 5), according to a first exemplary embodiment of the disclosure. The tray 105 can be used to hold a food product (not shown). In the illustrated embodiment, the tray 105 is generally rectangular-shaped and can be suitable for holding a food product of any shape (e.g., vegetables, fruit, sliced deli meats or cheeses, ground beef, chicken cutlets, etc.) in a suitable manner for purchase at a grocery store or other retailer, but the package could be otherwise shaped with the same or a different number of side panels to hold correspondingly shaped food products. Further, the tray 105 and blank 103 may be alternatively sized, shaped and/or otherwise arranged to hold any number of food products including a single food product or more than two food products. In one embodiment, the tray 105 is useful for holding the food product during storage in a refrigerator, a freezer, on display on shelves or in a deli case, during heating and/or cooking, and/or during serving or consumption of the food product.

As shown in FIG. 1, the tray blank 103 has a longitudinal axis L1 and a lateral axis L2. In the illustrated embodiment, the tray blank 103 comprises a bottom panel 110 foldably connected to a first side panel 112 at a lateral first fold line 114. A second side panel 116 is foldably connected to the bottom panel 110 at a lateral second fold line 118. A first end panel 120 is foldably connected to the bottom panel 110 at a longitudinal third fold line 122, and a second end panel 124 is foldably connected to the bottom panel 110 at a longitudinal fourth fold line 126. The blank 103 includes gusset panels 128, 130 respectively foldably connected to the first side panel 112 at fold lines 132, 134 located at respective ends of the first side panel. Gusset panels 136, 138 are respectively foldably connected to the second side panel 116 at fold lines 140, 142 located at respective ends of the second side panel. The gusset panels 128, 136 can be separable from respective ends of the first end panel 120 along tear lines or cuts 144, and the gusset panels 130, 138 can be separable from respective ends of the second end panel 124 along tear lines or cuts 146.

As shown in FIG. 1, a first reinforcing structure 147 (broadly, "first reinforcing structure features") and a second reinforcing structure 159 (broadly, "second reinforcing structure features") can be foldably connected to the respective first and second side panels 112, 116. The first reinforcing structure 147 can include a first reinforcement panel 148 foldably connected to the first side panel 112 along a lateral fold line 150 and a second reinforcement panel 152 foldably connected to the first reinforcement panel 148 along a lateral fold line 154. The second reinforcing structure 159 can include a first reinforcement panel 160 foldably connected to the second side panel 116 along a lateral fold line 162 and a second reinforcement panel 164 foldably connected to the first reinforcement panel 160 along a lateral fold line 166. In one embodiment, the fold lines 150, 162 are crease lines but the fold lines could be other lines of weakening (e.g., lines of weakening formed by partial or full cuts separated by nicks or portions of material between the cuts that are free from any form of weakening, cut/crease lines, etc.) without departing from the disclosure. Further, as shown in FIG. 1, the fold lines 154, 166 are lines of weakening formed by full cuts separated by nicks or portions of material between the cuts that are free from any form of weakening, but it is understood that the fold lines 154, 166 could be other lines of weakening without departing from the disclosure.

In the illustrated embodiment, each of the first and second end panels 120, 124 can include a respective end reinforcement flap 172, 174 respectively foldably connected to one of the first and second end panels at a respective longitudinal fold line 176, 178. The first and second end panels 120, 124 can include a lip or edge 173, 175 on either or both sides of the of the end panels adjacent the respective end reinforcement flaps 172, 174. In one embodiment, the edges 173, 175 extend obliquely from respective ends of the fold line 176, 178. The blank 103 could be otherwise shaped, arranged, and/or configured without departing from the disclosure. For example, the gusset panels could be foldably connected to the end panels 120, 124 instead of the side panels 112, 116, or the gusset panels could be omitted. Additionally, any of the panels and flaps of the blank 103 can be omitted without departing from the scope of this disclosure.

As shown in FIGS. 1-5, the blank 103 is formed into the tray 105 with an interior 107 by folding the first and second side panels 112, 116 and the first and second end panels 120, 124 relative to the bottom panel 110 along respective fold lines 114, 118, 122, 126. The gusset panels 128, 136 are folded along the respective fold lines 132, 140 and adhered in face-to-face contact with an interior surface of the first end panel 120 so that the gusset panels are attached to the end panel and form a portion of the interior 107 of the tray 105. The gusset panels 130, 138 are folded along the respective fold lines 134, 142 and adhered in face-to-face contact with an interior surface of the second end panel 124 so that the gusset panels are attached to the end panel and form a portion of the interior 107 of the tray 105. Accordingly, the erected gusset panels 128, 130, 136, 138 in face-to-face contact with the respective end panels 120, 124 form reinforced ends 182, 184 of the tray 105. The ends 182, 184 of the tray 105 can be alternatively, shaped, arranged, and/or configured without departing from the disclosure.

Figure 3:
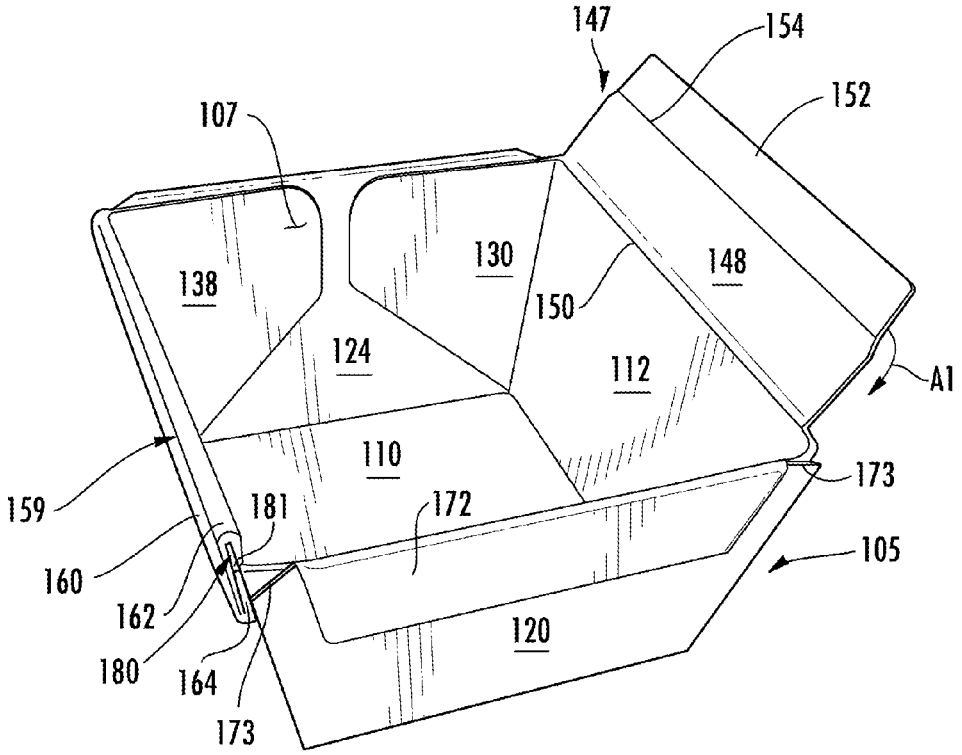
FIGS. 3-5 illustrate a method of forming a reinforcement structure in the tray of FIG. 2 according to the first embodiment of the disclosure.
Figure 4:
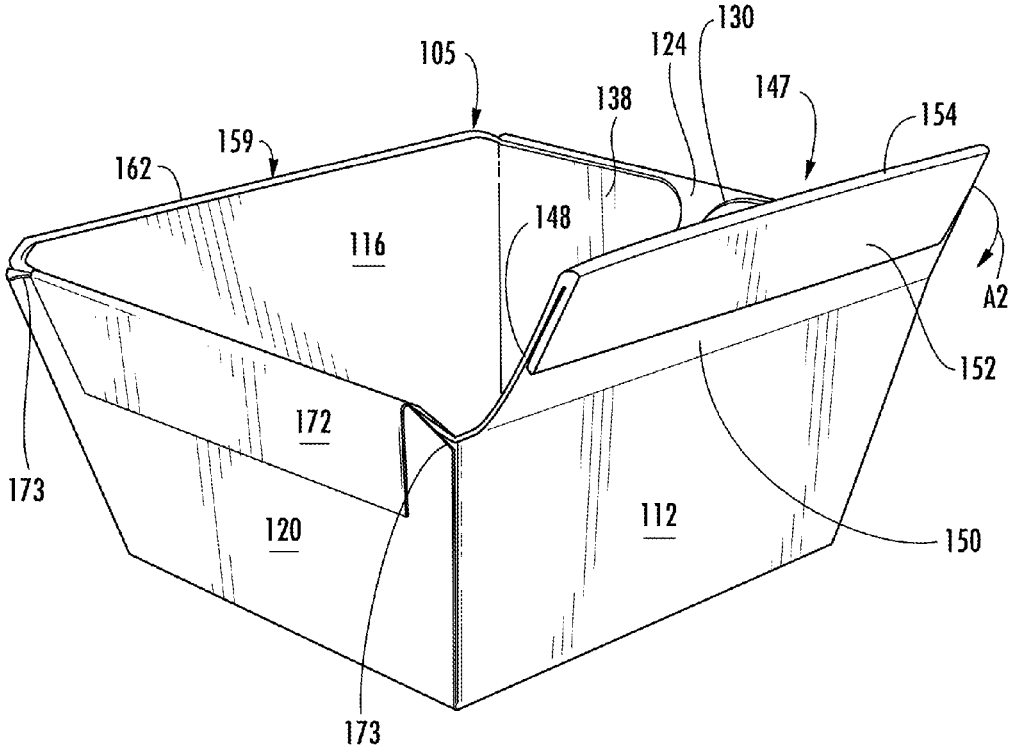
Figure 5:
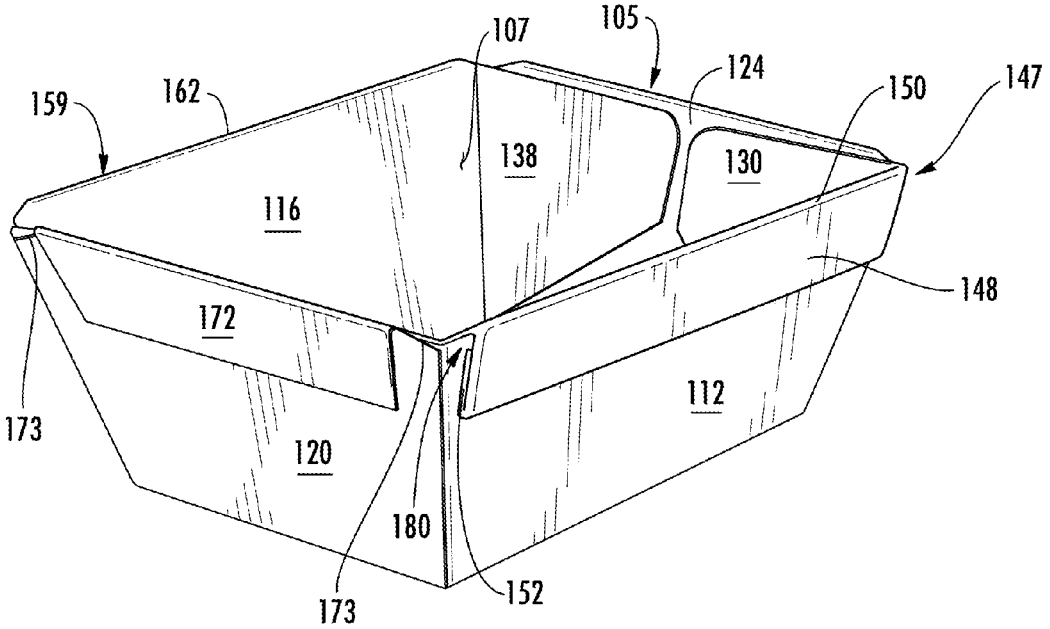

As shown in FIGS. 3-5, the first reinforcing structure 147 can be formed to reinforce the rim of the tray 105 by folding the second reinforcement panel 152 relative to the first reinforcement panel 148 at fold line 154, in the direction of arrow A1 (FIG. 3), and adhering the second reinforcement panel 154 in face-to-face contact with the first reinforcement panel 147 (FIGS. 3 and 4). From the position shown in FIG.

4, the first reinforcement panel 148 with the second reinforcement panel 152 attached thereto is downwardly folded in the direction of arrow A2 and adhered to the upper portion of the first side panel 112. The folding sequence of the reinforcing structure 147 provides three layers of material at the upper portion or rim of the first side panel 112, with the second reinforcement panel 152 attached to the upper portion of the first side panel and attached to the first reinforcement panel 148. In this way the second reinforcement panel 152 is in face-to-face contact with both the first side panel 112 and the first reinforcement panel 148 to reinforce the upper portion or rim of the first side panel. The second reinforcing structure 159 can be formed to reinforce the rim of the tray 105 in a similar manner as the first reinforcing structure 147 so that the second reinforcement panel 164 is in face-to-face contact between and attached to both of the second side panel 116 and the first reinforcement portion. When the reinforcing structures 147, 159 are formed, the fold lines 150, 162 form the upper edge of the tray 105 at the side panels 112, 116 with the reinforcing structures being foldably connected to the side panels at the fold lines 150, 162 and depending downwardly from the upper edges to reinforce the upper portion or rim of the tray. The reinforcing structures 147, 159 can be alternatively configured or formed without departing from the scope of this disclosure. For example, reinforcing structures 147, 159 could be formed on blank 103 before folding the side panels 112, 116, end panels 120, 124 and adhering gusset panels 128, 130, 136, 138.

As illustrated in FIG. 1, the second reinforcement panels 152, 164 have a longitudinal width less than the longitudinal width of the first reinforcement panels 148, 160 such that when the reinforcing rim structures 147, 159 are formed the first reinforcement panels 148, 160 are spaced apart from the respective side panels 112, 116. Accordingly, the reinforcing rim structures 147, 159 form respective hollow rims 180 (FIGS. 3 and 5) defined between the first reinforcement panel 148, 160 and the respective side panel 112, 116. Further the hollow rims 180 may be defined by the respective free edge 181 (FIG. 3) of the respective second reinforcement panel 152, 164 and the respective fold lines 150, 162. The hollow rims 180 could be alternatively configured or formed without departing from the scope of this disclosure.

As shown in FIGS. 2-5, the end reinforcement flaps 172, 174 can be downwardly folded along the respective fold lines 176, 178 and adhered in face-to-face contact with respective end panels 120, 124. As such, the reinforced ends 182, 184 of the tray 105 comprise the respective end panels 120, 124, the respective pairs of gusset panels 128, 136 and 130, 138 that are folded in face-to-face contact with the respective end panels 120, 124, and the respective reinforcement flaps 172, 174 that are downwardly folded to overlap the respective end panels 120, 124. The tray 105 can be formed by other flap or panel positioning steps, and the tray 105 could be otherwise shaped, arranged, and/or configured without departing from the disclosure. For example, reinforcement flaps 172, 174 could be folded and adhered on blank 103 prior to forming the tray 105.

In the illustrated embodiment, the side panels 112, 116 and the end panels 120, 124 of the assembled tray 105 are sloped so that multiple trays 105 can be stacked with one or more trays each nested in the tray below. The reinforcing rim structures 147, 159 reinforce the upper portions of the side panels 112, 116 of the tray 105 and the reinforcement flaps 172, 174 and gusset panels 128, 136, 130, 138 reinforce the ends 182, 184 of the tray 105. The blank 103 and/or tray 105 could have other reinforcing features without departing from the disclosure.

One or more products, such as raw or prepared food products (not shown), can be inserted into the interior 107 of the tray 105. In one exemplary embodiment, the tray and product(s) can be wrapped in plastic or other material, sealing the product(s) in the tray to keep the product(s) fresh, to prevent contamination of the product(s), and/or to help prevent leaking of fluids. Additionally, an insert, a coating, an absorption pad, or other features can be applied to the tray to help control fluids and/or retain the product(s) in the tray.

Logos, brand information, product information, other printed material, or combinations thereof can be printed on any surface of the tray 105. In one embodiment, the coated exterior surface 101 of the blank 103 provides ideal surfaces of the tray for printing graphics or other indicia. In the illustrated embodiment, the tray 105 can include tear-away panels (not shown) or other features for including coupons, recipes, or other value-added features. In one exemplary embodiment, the tray 105 comprises paperboard and provides a collapsible, crushable, and degradable tray for helping to reduce the volume and duration of waste. Additionally, the paperboard can be recyclable.

In one embodiment, the tray 105 can be formed with the uncoated (interior) surface of the blank 103 forming the interior surface 107 of the tray, but the tray could be otherwise formed such that the coated (exterior) surface 101 of the blank forms the interior surface of the tray without departing from the disclosure. Also, the gusset panels 128, 136, 130, 138 could be positioned on the exterior surface of one or both of the end panels 120, 124 to form the reinforced ends 182, 184 in an alternative manner without departing from the disclosure. In addition, the reinforcing structures 147, 159 could be folded over the interior surfaces of the respective side panels 112, 116 and/or the end reinforcement flaps 172, 174 could be folded over the interior surfaces of the respective end panels 120, 124. The tray 105 could be formed by other forming steps or processes without departing from the disclosure.

Figure 6:
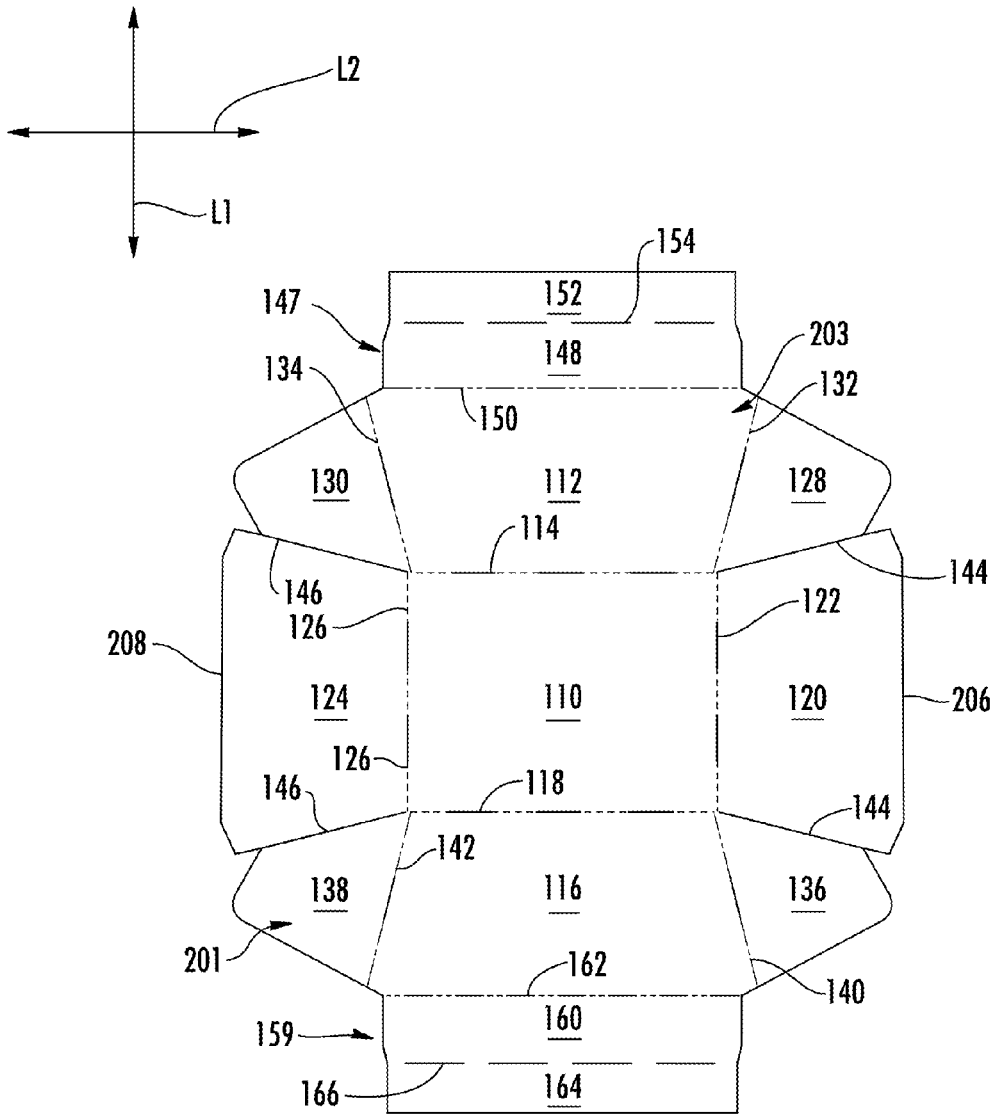
FIG. 6 is an interior plan view of a blank used to form a tray in accordance with a second embodiment of the disclosure.
Figure 7:
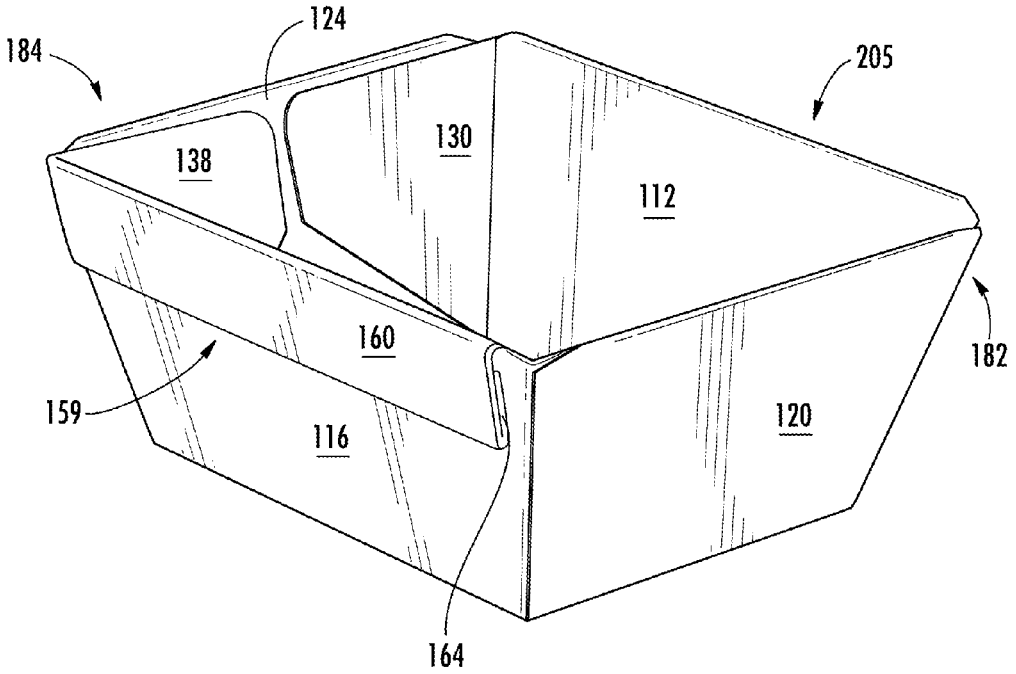
FIG. 7 is a perspective view of the tray formed from the blank of FIG. 6 according to the second embodiment of the disclosure.

FIG. 6 illustrates an interior side 201 of a blank 203 for forming a tray 205 (FIG. 7) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 6, the blank 203 includes end panels 120, 124 that have a longitudinal edge 206, 208 instead of the reinforcement flaps 172, 174 of the first embodiment. The reinforced ends 182, 184 of the tray 205 include the gusset panels 128, 136, 130, 138 attached to the interior surface of the end panels 120, 124. The blank 203 and/or tray 205 could have other features without departing from the disclosure.

Figure 8:
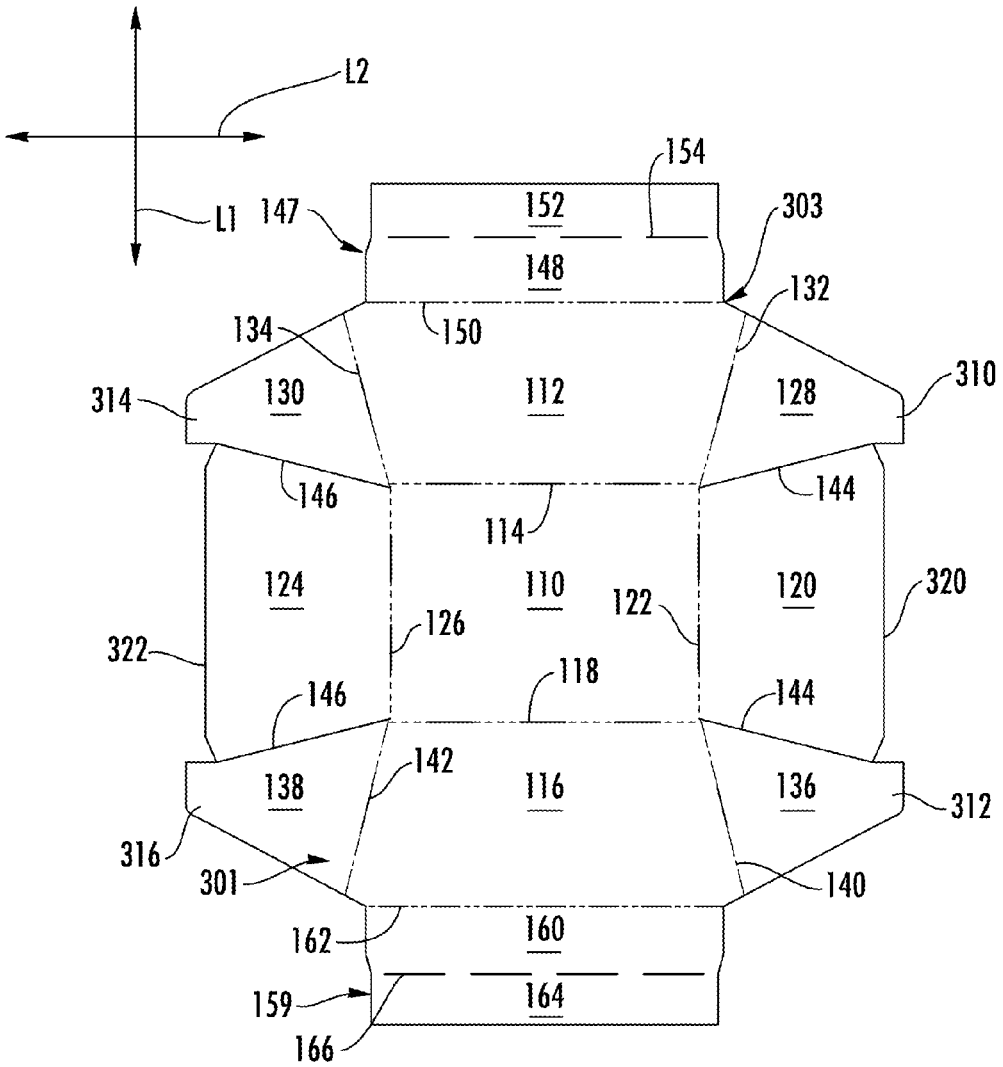
FIG. 8 is an interior plan view of a blank used to form a tray in accordance with a third embodiment of the disclosure.
Figure 9:
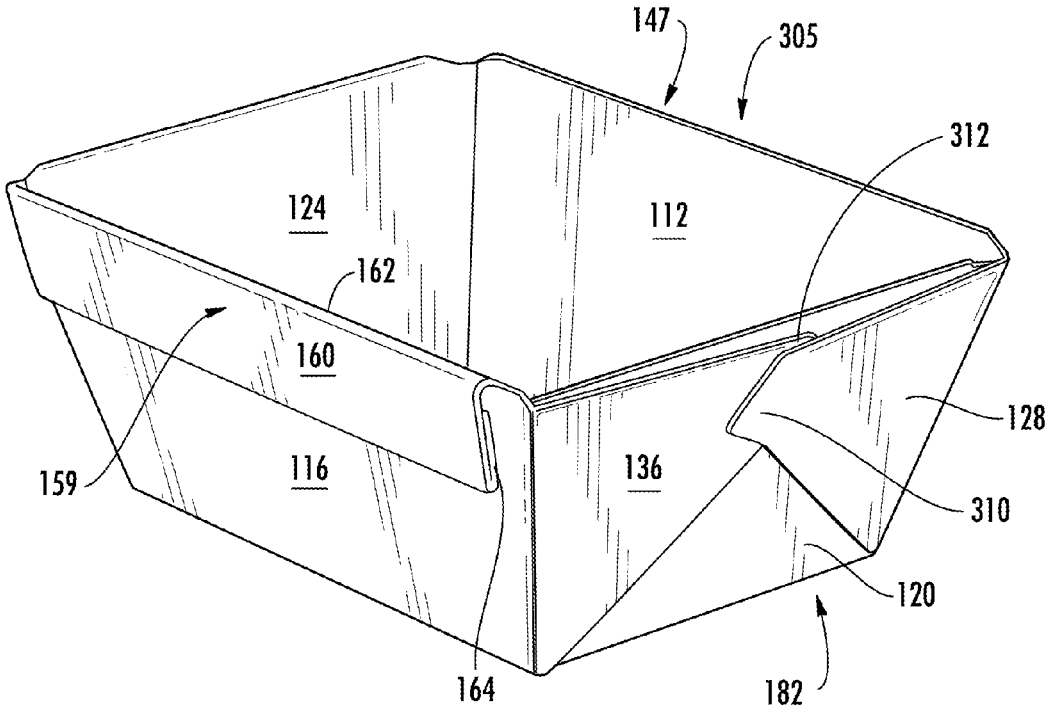
FIG. 9 is a perspective view of the tray formed from the blank of FIG. 8 according to the third embodiment of the disclosure.
Figures 10A, 10B, 10C:
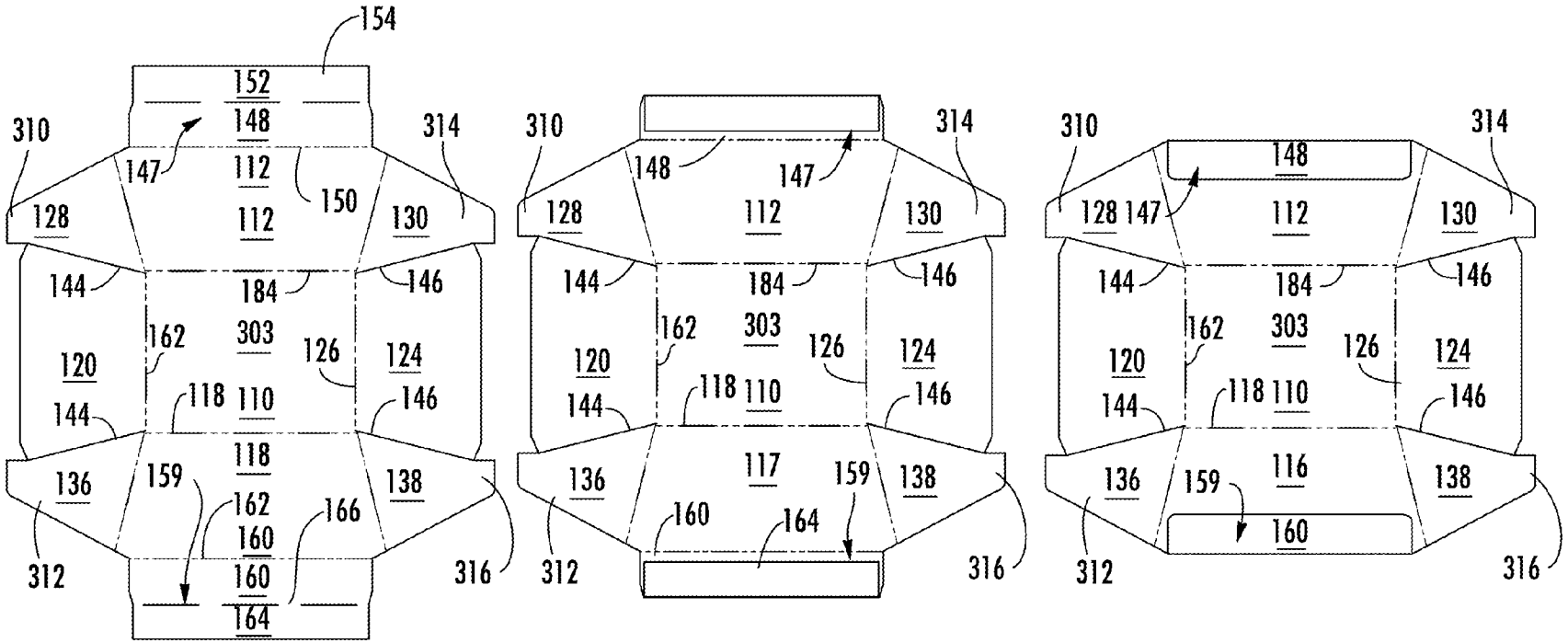
FIGS. 10A-10C illustrate a method of forming reinforcing structures in the blank of FIG. 8 according to the third embodiment of the disclosure.

FIG. 8 illustrates an interior side 301 of a blank 303 for forming a tray 305 (FIG. 9) according to a third embodiment of the disclosure. The third embodiment is generally similar to the first embodiment, except for variations noted and variations that will be apparent to one of ordinary skill in the art. Accordingly, similar or identical features of the embodiments have been given like or similar reference numbers. In the embodiment of FIG. 8, the gusset panels 128, 136, 130, 138 have extension flaps or tabs 310, 312, 314, 316 that extend beyond the edge 320, 322 of the respective end panel 120, 124. As shown in FIG. 9, the gusset panels 128, 136, 130, 138 can be outwardly folded to be in face-to-face contact with the exterior surface of the respective end panels 120, 124. In one embodiment, the extension flap 310 of the gusset panel 128 overlaps the extension panel 312 of the gusset panel 136 at the first reinforced end 182 of the tray 305. The extension flap 314 of the gusset panel 130 overlaps the extension panel 316 of the gusset panel 138 at the second reinforced end 184 of the tray 305. Accordingly, the erected gusset panels 128, 130, 136, 138 form reinforced ends 182, 184 of the tray 305 with the gusset panels being overlapped and on the exterior of the tray. In one exemplary embodiment, FIGS. 10A-10C illustrate the exterior side of the blank 303 and the formation of the reinforcing structures 147, 159. As illustrated in FIG. 10B, the second reinforcement panels 152, 164 can be folded along the respective fold line 154, 166 and positioned in face-to-face contact with the respective first reinforcement panels 148, 160. The combined first and second reinforcement panels 148, 152 and 160, 164 can be folded along fold lines 150, 162 and the second reinforcement panel 152, 164 can be positioned in face-to-face contact with the exterior surface of the respective side panel 112, 116, as illustrated in FIG. 10C. In one embodiment, the second reinforcement panels 152, 164 can be adhered to the respective first reinforcement panels 148, 160 and to the respective side panels 112, 116. The blank 303 and/or tray 305 could have other features without departing from the disclosure.

Figure 11:
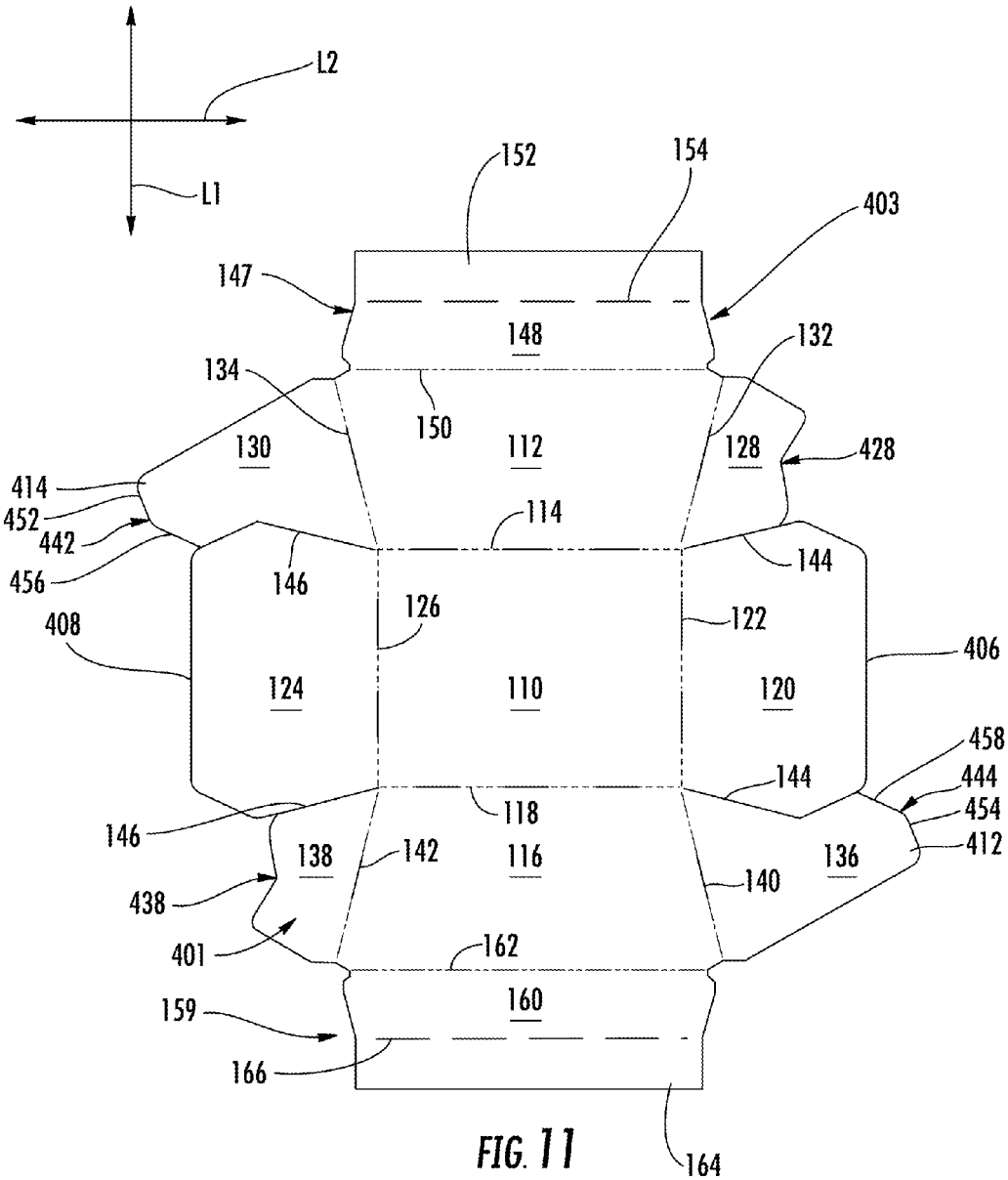
FIG. 11 is an exterior plan view of a blank used to form a tray in accordance with a fourth embodiment of the disclosure.
Figure 12:
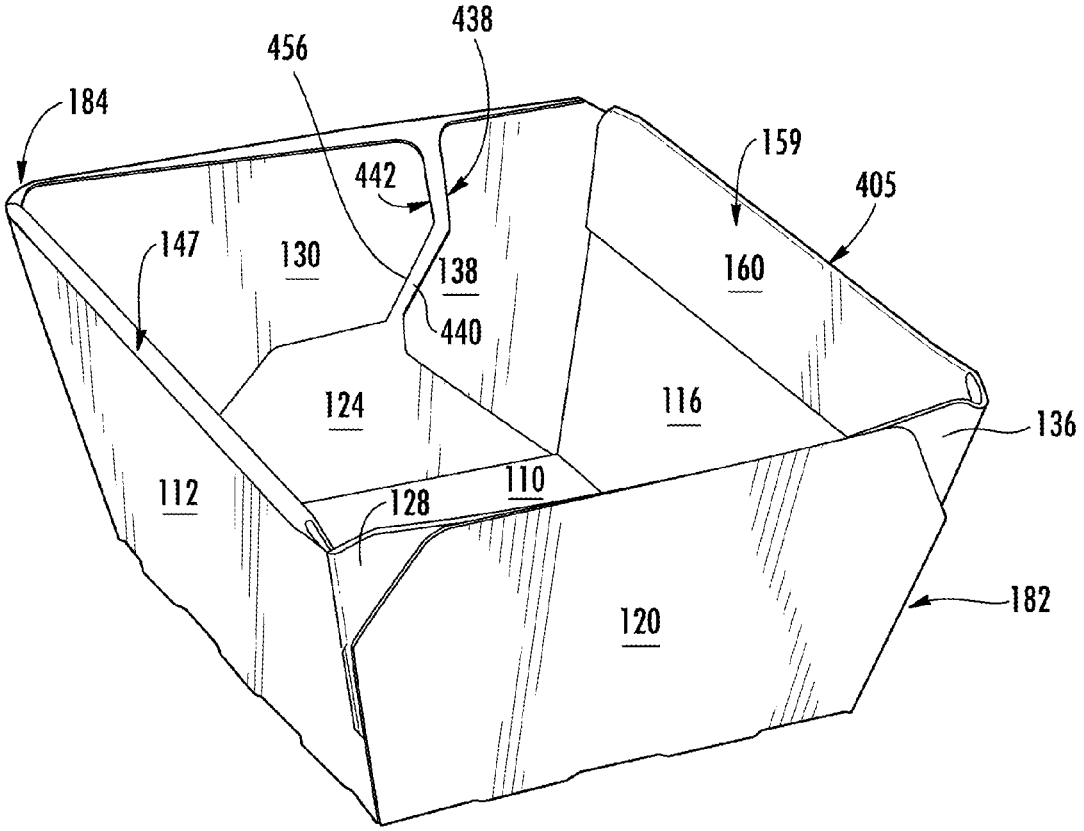
FIG. 12 is a perspective view of the tray formed from the blank of FIG. 11 according to the fourth embodiment of the disclosure.

FIG. 11 illustrates an exterior side 401 of a blank 403 for forming a tray 405, with an interior 407 (FIG. 12), according to a fourth embodiment of the disclosure. The fourth embodiment is generally similar to the first embodiment, except for variations noted and variations that will be apparent to one of ordinary skill in the art. Accordingly, similar or identical features of the embodiments have been given like or similar reference numbers. As shown in FIGS. 11-12, the blank 403 includes end panels 120, 124 that have a longitudinal edge 406, 408 instead of the reinforcement flaps 172, 174 of the first embodiment. In the embodiment of FIG. 11, the gusset panels 136, 130 have respective extension flaps or tabs 412, 414 that extend beyond the longitudinal edge 406, 408 of the respective end panel 120, 124. The extension flaps 414, 412 comprise edges 442, 444 having a first portion 452, 454 and a second portion 456, 458 oblique to the first portions. The gusset panels 128, 138 have notches or cutouts 428, 438 that are offset to interlock with or at least partially receive the respective edges 442, 444 of gusset panels 130, 136. When the carton is formed from the blank, the gusset panels 130, 136 extend across a respective end panel 120, 124. The edges 442, 444 of a respective extension flap 414, 412 mate with and are closely adjacent or abutting the notches 428, 438 of a respective gusset panel 128, 138 to form a diagonal interlock 440 that strengthens the end of the tray 405. The reinforced ends 182, 184 of the tray 405 include the gusset panels 128, 136, 130, 138 attached to the interior surface of the end panels 120, 124. In the embodiment of FIG. 12, the reinforcing structures 147, 159 are positioned to be in face-to-face contact with the interior surface of the respective side panels 112, 116. The blank 403 and/or tray 405 could have other features without departing from the disclosure.

Figure 13:
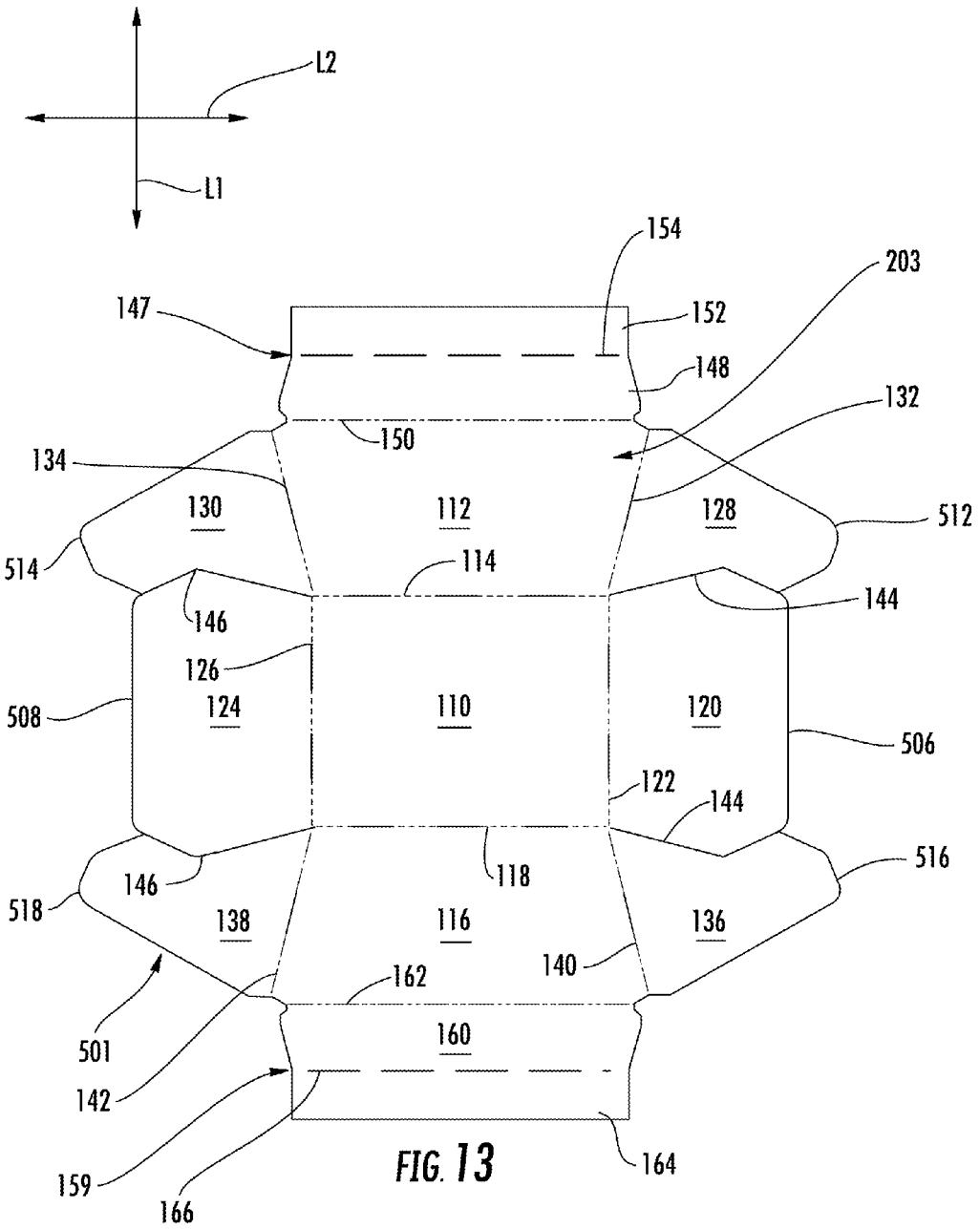
FIG. 13 is an interior plan view of a blank used to form a tray in accordance with a fifth embodiment of the disclosure.
Figure 14:
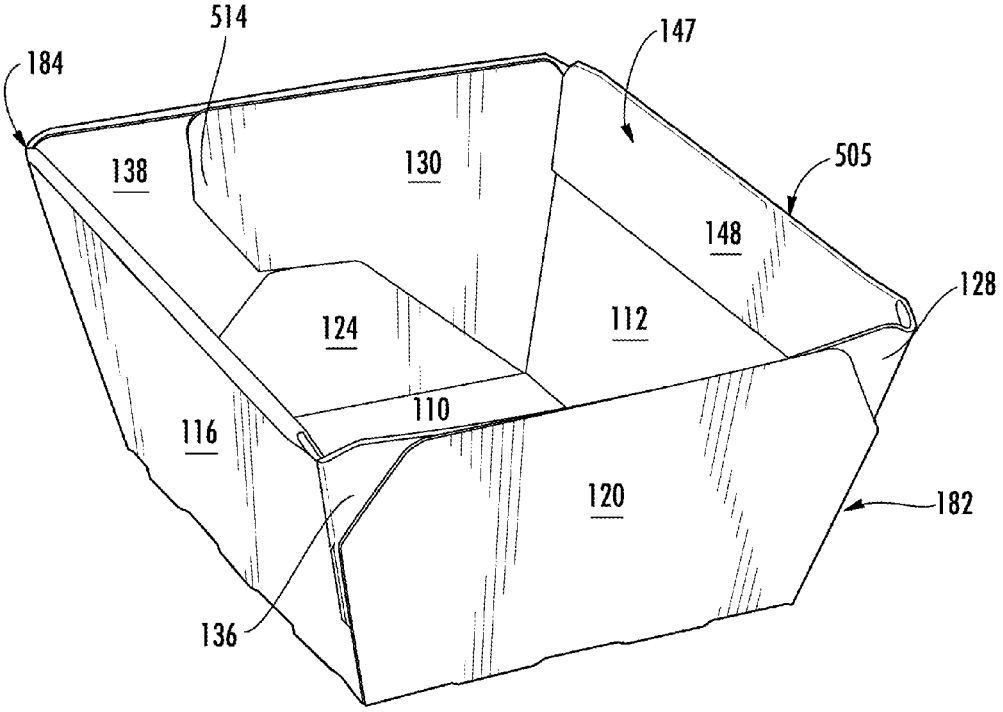
FIG. 14 is a perspective view of the tray formed from the blank of FIG. 13 according to the fifth embodiment of the disclosure.

FIG. 13 illustrates an interior side 501 of a blank 503 for forming a tray 505 with an interior 507 (FIG. 14) according to a fifth embodiment of the disclosure. The fifth embodiment is generally similar to the first embodiment, except for variations noted and variations that will be apparent to one of ordinary skill in the art. Accordingly, similar or identical features of the embodiments have been given like or similar reference numbers. As shown in FIG. 13, the blank 503 includes end panels 120, 124 that have a longitudinal edge 506, 508 instead of the reinforcement flaps 172, 174 of the first embodiment. In the embodiment of FIG. 13, the gusset panels 128, 130, 136, 138 have respective extension flaps or tabs 512, 514, 516, 518 that extend beyond the longitudinal edges 506, 508 of the respective end panels 120, 124. As shown in FIG. 14, the gusset panels 128, 136, 130, 138 can be inwardly folded to be in face-to-face contact with the interior surface of the respective end panels 120, 124. In one embodiment, the extension flap 512 of the gusset panel 128 overlaps the extension flap 516 of the gusset panel 136 at the first reinforced end 182 of the tray 505. Similarly, the extension flap 514 of the gusset panel 130 can overlap the extension flap 518 of the gusset panel 138 at the second reinforced end 184 of the tray 505. Accordingly, the erected gusset panels 128, 130, 136, 138 form reinforced ends 182, 184 of the tray 505 with the gusset panels being overlapped and on the interior of the tray. As shown in FIG. 14, the reinforcing structures 147, 159 can be folded over the interior surface of the respective side panels 112, 116. The blank 503 and/or tray 505 could have other features without departing from the disclosure.

Figure 15:
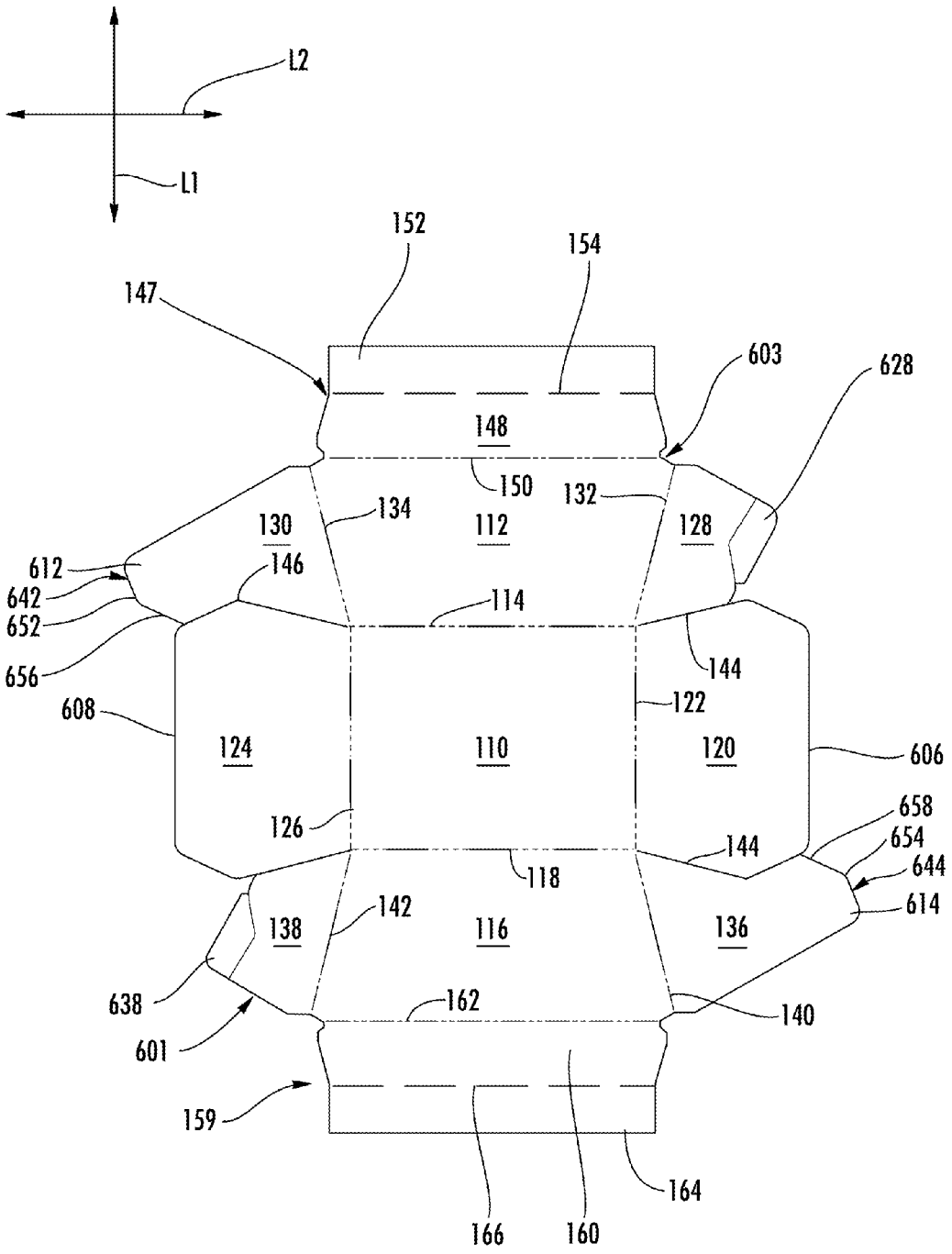
FIG. 15 is an exterior plan view of a blank used to form a tray in accordance with a sixth embodiment of the disclosure.
Figure 16:
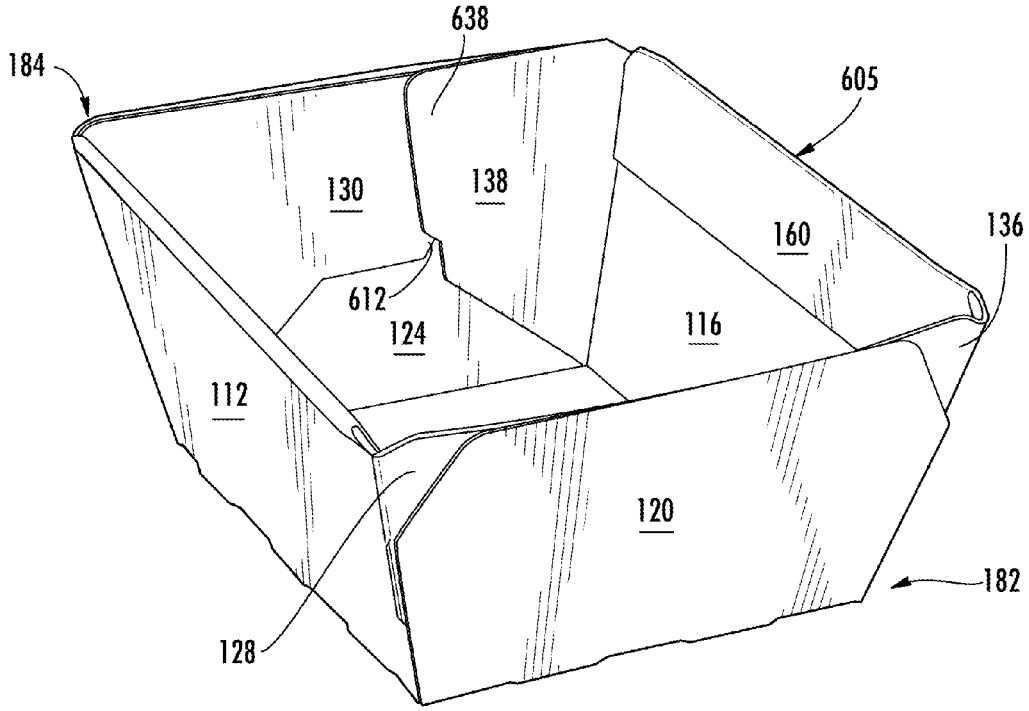
FIG. 16 is a perspective view of the tray formed from the blank of FIG. 15 according to the sixth embodiment of the disclosure.

FIG. 15 illustrates an exterior side 601 of a blank 603 for forming a tray 605 with an interior 607 (FIG. 16) according to a sixth embodiment of the disclosure. The sixth embodiment is generally similar to the first embodiment, except for variations noted and variations that will be apparent to one of ordinary skill in the art. Accordingly, similar or identical features of the embodiments have been given like or similar reference numbers. As shown in FIG. 15, the blank 603 includes end panels 120, 124 that have a longitudinal edge 606, 608 instead of the reinforcement flaps 172, 174 of the first embodiment. In the embodiment of FIG. 15, the gusset panels 130, 136 have an extension flap 612, 614 that extend beyond the longitudinal edge 608, 606 of the respective end panel 124, 120. The extension flaps 612, 614 comprise edges 642, 644 having a first portion 652, 654 and a second portion 656, 658 oblique to the first portions as illustrated in FIG. 15. The gusset panels 128, 138 have respective embossed portions 628, 638 that are shaped to at least partially receive and/or mate with at least a portion of the respective extension flaps 612, 614. In one embodiment, the embossed portions 628, 638 define respective recesses in the respective gusset panels 128, 138. When the carton is formed from the blank, the reinforcing structures 147, 159 are folded over and adhered to the interior surface of the side panels 112, 116 as shown in FIG. 16. Further, the extension flaps 612, 614 extend across the center of the end panels 120, 124 and at least partially overlap the embossed portion 628, 638 of the gusset panels 128, 138. In one embodiment, the emboss feature could be configured to receive the extension tab on the exterior side of emboss and/or interior side of emboss feature with departing from the disclosure. For example, the emboss features can form an offset portion of the respective gusset panels 128, 138 and/or a recess for accommodating the thickness of the extension flaps 612, 614. Glue or other adhesive can be applied to the embossed portions 628, 638 or the extension flaps 612, 614 to secure the gusset panels 128, 136 and 130, 138. The reinforced ends 182, 184 of the tray 605 include the gusset panels 128, 136, 130, 138 attached to the interior surface of the end panels 120, 124. The blank 603 and/or tray 605 could have other features without departing from the disclosure.

Figure 17:
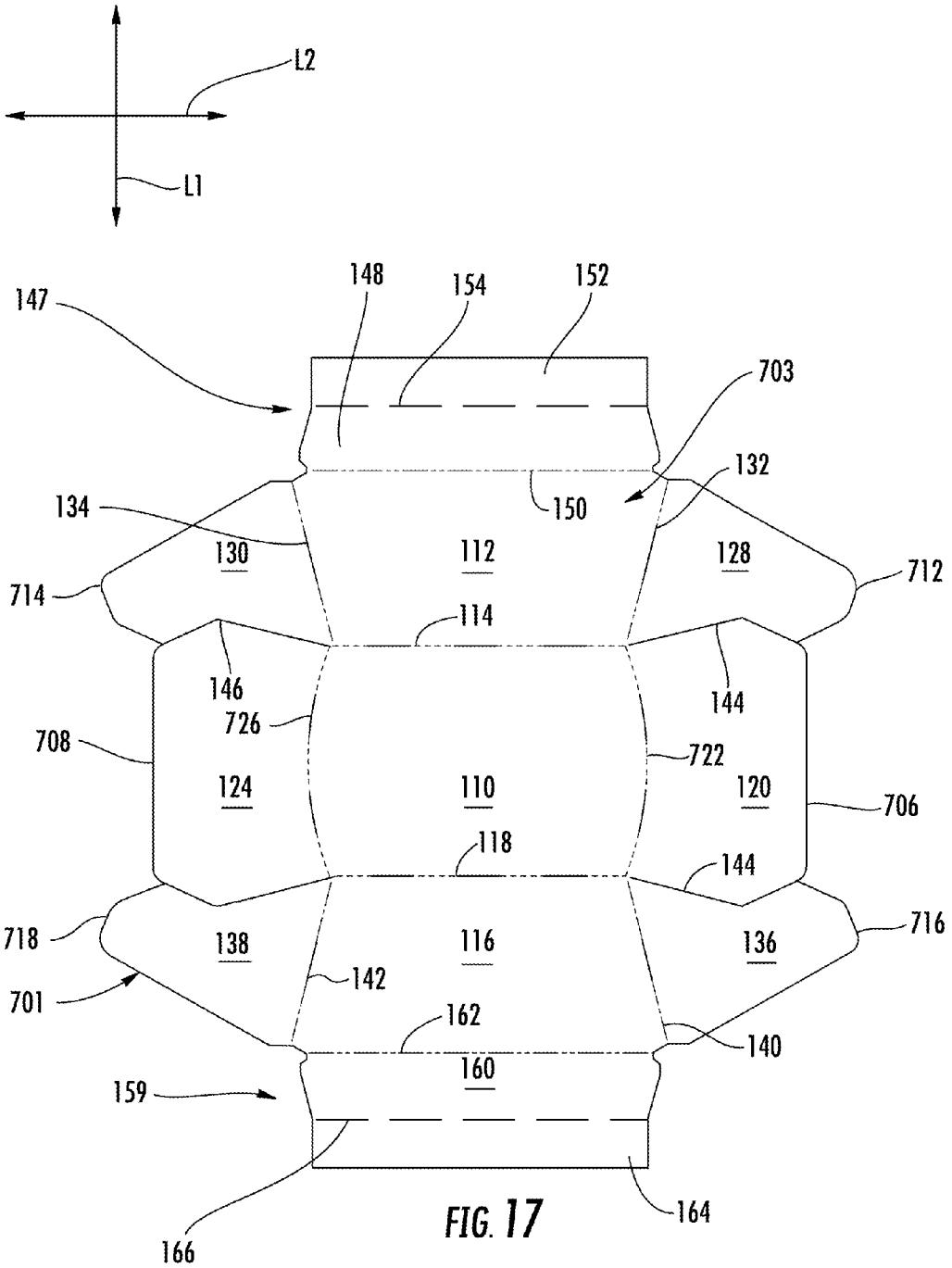
FIG. 17 is an interior plan view of a blank used to form a tray in accordance with a seventh embodiment of the disclosure.
Figure 18:
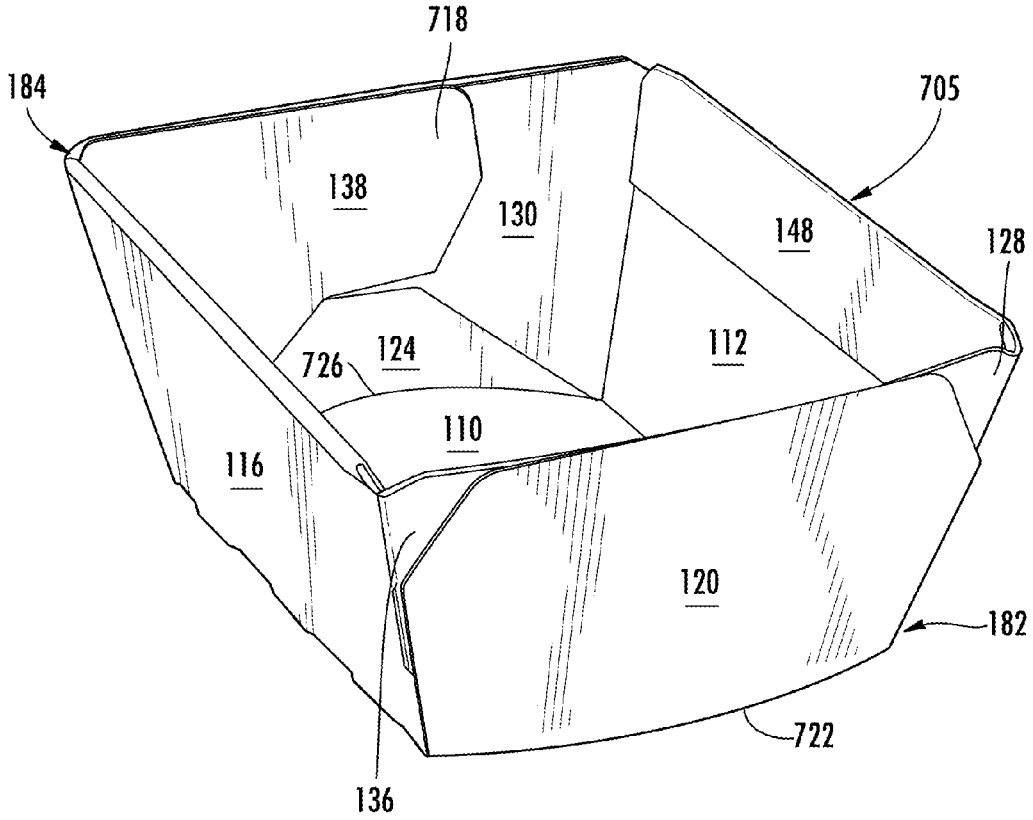
FIG. 18 is a perspective view of the tray formed from the blank of FIG. 17 according to the seventh embodiment of the disclosure.

FIG. 17 illustrates an interior side 701 of a blank 703 for forming a tray 705 with an interior 707 (FIG. 18) according to a seventh embodiment of the disclosure. The seventh embodiment is generally similar to the first embodiment, except for variations noted and variations that will be apparent to one of ordinary skill in the art. Accordingly, similar or identical features of the embodiments have been given like or similar reference numbers. As shown in FIG. 17, the blank 703 includes end panels 120, 124 that have a longitudinal edge 706, 708 instead of the reinforcement flaps 172, 174 of the first embodiment. In the embodiment of FIG. 17, the gusset panels 128, 130, 136, 138 have an extension flap 712, 714, 716, 718 that extend beyond the longitudinal edge 706, 708 of the respective end panel 120, 124. As shown in FIG. 18, the gusset panels 128, 136, 130, 138 can be inwardly folded to be in face-to-face contact with the interior surface of the respective end panels 120, 124. In one embodiment, the extension flap 712 of the gusset panel 128 overlaps the extension panel 716 of the gusset panel 136 at the first reinforced end 182 of the tray 505. The extension flap 714 of the gusset panel 130 overlaps the extension panel 718 of the gusset panel 138 at the second reinforced end 184 of the tray 705. In one embodiment, the end panels 120, 124 are connected to the bottom panel 110 along respective third and fourth fold lines 722, 726 that are arcuate or convexly curved relative to the bottom panel 110 (or, alternatively, concave relative to the end panels 120, 122). When the carton 705 is formed from the blank, the arcuate fold lines 722, 726 cause the end panels 120, 124 to bend or bow outward increasing force resistance of the end panels and creating a more stable footing. In the embodiment of FIG. 18, the reinforcing structures 147, 159 are positioned to be in face-to-face contact with the interior surface of a respective side panel 112, 116. The blank 703 and/or tray 705 could have other features without departing from the disclosure.

Figure 19:
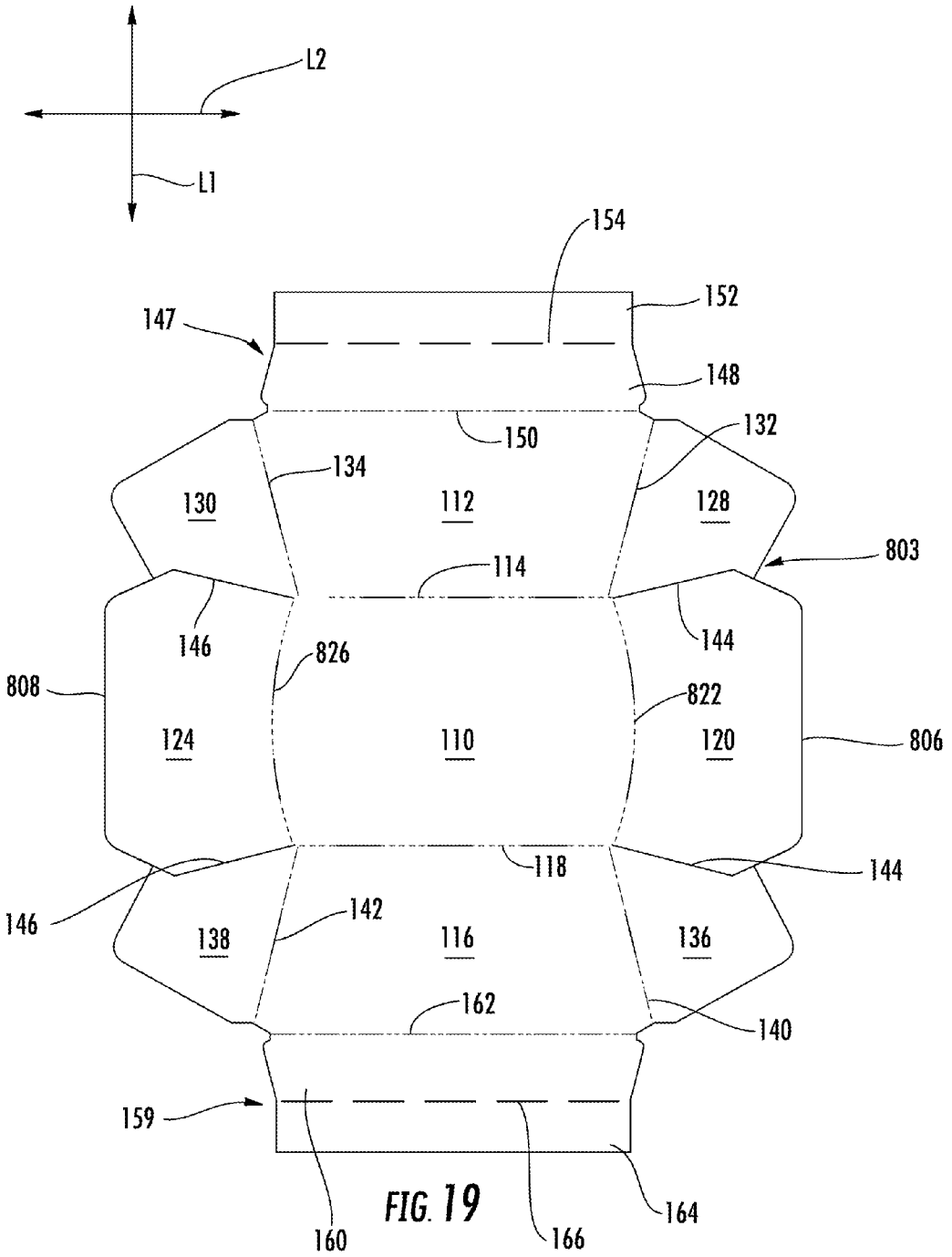
FIG. 19 is an interior plan view of a blank used to form a tray in accordance with an eighth embodiment of the disclosure.
Figure 20:
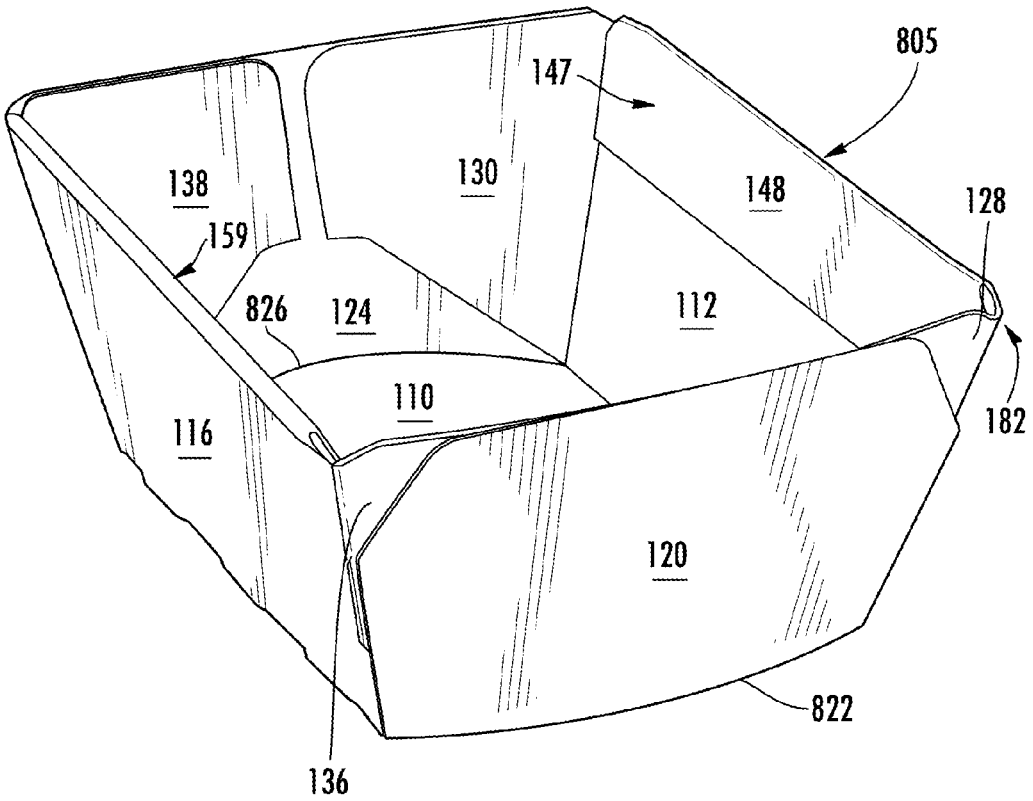
FIG. 20 is a perspective view of the tray formed from the blank of FIG. 19 according to the eighth embodiment of the disclosure.

FIG. 19 illustrates an interior side 801 of a blank 803 for forming a tray 805 with an interior 807 (FIG. 20) according to an eighth embodiment of the disclosure. The eighth embodiment is generally similar to the first embodiment, except for variations noted and variations that will be apparent to one of ordinary skill in the art. Accordingly, similar or identical features of the embodiments have been given like or similar reference numbers. As shown in FIG. 19, the blank 803 includes end panels 120, 124 that have a longitudinal edge 806, 808 instead of the reinforcement flaps 172, 174 of the first embodiment. In one embodiment, the third and fourth fold lines 822, 826 are arcuate or convexly curved relative to the bottom panel 110 (or, alternatively, concave relative to the end panels 120, 122). When the carton 805 is formed from the blank, the arcuate fold lines 822, 826 cause the end panels 120, 124 to bend or bow outward increasing force resistance of the end panels and creating a more stable footing. In the embodiment of FIG. 20, the reinforcing structures 147, 159 are positioned to be in face-to-face contact with the interior surface of a respective side panel 112, 116. The blank 803 and/or tray 805 could have other features without departing from the disclosure.

Any of the various embodiments of the present disclosure generally could include at least one microwave energy interactive element that may comprise a susceptor for becoming hot when exposed to microwave energy, although other types and various combinations of microwave energy interactive elements are also within the scope of the present disclosure. Also, the various embodiments of the present disclosure could be free of a microwave energy interactive element without departing from the disclosure.

A blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the package to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines may include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the package embodiments. The term "glue" is intended to encompass all manner of adhesives commonly used to secure package panels in place.

The foregoing description illustrates and describes various embodiments of the present disclosure. As various changes could be made in the above construction, it is intended that all matter contained in the above description or shown in the accompanying drawings shall be interpreted as illustrative and not in a limiting sense. Furthermore, the present disclosure covers various modifications, combinations, and alterations, etc., of the above-described embodiments that are within the scope of the claims. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A tray for holding a food product, the tray comprising:

a plurality of panels that extend at least partially around an interior of the tray, the plurality of panels comprises a bottom panel, a side panel foldably connected to the bottom panel, and an end panel foldably connected to the bottom panel;

a reinforcing structure comprising a first reinforcement panel foldably connected to at least one panel of the plurality of panels, and a second reinforcement panel foldably connected to the first reinforcement panel, the reinforcing structure forms a hollow rim defining an empty space between the first reinforcement panel and the at least one panel; and a gusset panel foldably connected to the side panel, the gusset panel and the end panel at least partially overlapping on another, the tray comprising paperboard.

2. The tray of claim 1, wherein the second reinforcement panel at least partially overlaps the side panel, and the first reinforcement panel at least partially overlaps the second reinforcement panel.

3. The tray of claim 2, wherein the second reinforcement panel at least partially overlaps an exterior surface of the side panel.

4. The tray of claim 2, wherein the second reinforcement panel at least partially overlaps an interior surface of the side panel.

5. The tray of claim 1, wherein the first reinforcement panel is foldably connected to the side panel along a fold line, and the hollow rim is further at least partially defined by an edge of the second reinforcement panel and the fold line.

6. The tray of claim 5, wherein the first reinforcement panel is spaced apart from the side panel at the hollow rim, and the edge of the second reinforcement panel is spaced apart from the fold line at the hollow rim.

7. The tray of claim 1, wherein the second reinforcement panel is in face-to-face contact with each of the side panel and the first reinforcement panel so that the reinforcing structure comprises three layers of material at an upper portion of the side panel.

8. The tray of claim 1, wherein the side panel is a first side panel, the reinforcing structure is a first reinforcing structure, the first reinforcing structure is foldably connected to the first side panel, and the tray further comprises a second side panel foldably connected the bottom panel and a second reinforcing structure foldably connected to the second side panel.

9. The tray of claim 8, wherein the second reinforcing structure comprises a third reinforcement panel foldably connected to the second side panel and a fourth reinforcement panel foldably connected to the third reinforcement panel.

10. The tray of claim 9, wherein the second reinforcement panel at least partially overlaps the first side panel, the first reinforcement panel at least partially overlaps the second reinforcement panel, the fourth reinforcement panel at least partially overlaps the second side panel, and the third reinforcement panel at least partially overlaps the fourth reinforcement panel.

11. The tray of claim 9, wherein the end panel comprises a first end panel, the plurality of panels further comprises a second end panel foldably connected to the bottom panel, and the tray further comprises:

a first reinforcement flap foldably connected to the first end panel, the first reinforcement flap being at least partially in face-to-face contact with an exterior surface of the first end panel; and a second reinforcement flap foldably connected to the second end panel, the second reinforcement flap being at least partially in face-to-face contact with an exterior surface of the second end panel.

12. The tray of claim 11, wherein the first side panel, the second side panel, the first end panel and the second end panel are sloped so that one or more trays may be stacked together in an at least partially nested relationship.

13. The tray of claim 1, further comprising a reinforcement flap foldably connected to the end panel, the reinforcement flap at least partially overlapping the end panel.

14. The tray of claim 13, wherein reinforcement flap is at least partially in face-to-face contact with an exterior surface of the end panel.

15. The tray of claim 13, wherein the first reinforcement panel is foldably connected to the side panel along a first fold line, the reinforcement flap is foldably connected to the end panel along a second fold line, and the second fold line is generally perpendicular to the first fold line.

16. The tray of claim 13, wherein the end panel is a first end panel, the reinforcement flap is a first reinforcement flap, and the tray further comprises a second end panel foldably connected to the bottom panel and a second reinforcement flap foldably connected to the second end panel, the second reinforcement flap at least partially overlapping the second end panel.

17. The tray of claim 1, wherein the side panel is a first side panel, the gusset panel is a first gusset panel, the plurality of panels further comprises a second side panel foldably connected to the bottom panel and disposed opposite to the first side panel, the tray further comprises a second gusset panel foldably connected to the second side panel, and the second gusset panel and the end panel at least partially overlap one another.

18. The tray of claim 17, wherein the first gusset panel comprises a first extension tab, the second gusset panel comprises a second extension tab, and the first extension tab and the second extension tab at least partially overlap one another.

19. The tray of claim 18, wherein at least one of the first extension tab and the second extension tab is at least partially in face-to-face contact with the end panel.

20. The tray of claim 17, wherein the first gusset panel comprises a cutout having a first edge and the second gusset panel comprises an extension tab having a second edge, the extension tab extending at least partially into the cutout so that the first edge is adjacent the second edge.

21. The tray of claim 17, wherein the first gusset panel comprises an emboss portion, the second gusset panel comprises an extension tab, and the emboss portion at least partially overlaps at least a portion of the extension flap.

22. The tray of claim 21, wherein the emboss portion at least partially defines a recess, and the extension tab is at least partially received in the recess.

23. The tray of claim 1, wherein the end flap is foldably connected to the bottom panel along an arcuate fold line that is concave with respect to the bottom panel so that at least a portion of the end panel bends outwardly.

24. A blank for forming a tray for holding a food product, the blank comprising:

a plurality of panels comprising a bottom panel, a side panel foldably connected to the bottom panel, and an end panel foldably connected to the bottom panel;

reinforcing structure features comprising a first reinforcement panel foldably connected to at least one panel of the plurality of panels, and a second reinforcement panel foldably connected to the first reinforcement panel, the reinforcing structure features being for forming a hollow rim defining an empty space between the first reinforcement panel and the side panel when the tray is formed from the blank; and a gusset panel foldably connected to the side panel, the gusset panel and the end panel being for at least partially overlapping one another when the tray is formed from the blank, the blank comprising paperboard.

25. The blank of claim 24, wherein the second reinforcement panel is configured to at least partially overlap the side panel when the tray is formed from the blank, and the first reinforcement panel is configured to at least partially overlap the second reinforcement panel when the tray is formed from the blank.

26. The blank of claim 24, wherein the side panel is a first side panel, the reinforcing structure features are first reinforcing structure features, the first reinforcing structure features are foldably connected to the first side panel, and the blank further comprises a second side panel foldably connected the bottom panel and second reinforcing structure features foldably connected to the second side panel.

27. The blank of claim 26, wherein the second reinforcing structure features comprises a third reinforcement panel foldably connected to the second side panel and a fourth reinforcement panel foldably connected to the third reinforcement panel.

28. The blank of claim 27, wherein the end panel comprises a first end panel, the plurality of panels further comprises a second end panel foldably connected to the bottom panel, and the blank further comprises:

a first reinforcement flap foldably connected to the first end panel, the first reinforcement flap is for being positioned at least partially in face-to-face contact with an exterior surface of the first end panel when the tray is formed from the blank; and a second reinforcement flap foldably connected to the second end panel, the second reinforcement flap is for being positioned at least partially in face-to-face contact with an exterior surface of the second end panel when the tray is formed from the blank.

29. The blank of claim 24, further comprising a reinforcement flap foldably connected to the end panel, the reinforcement flap being configured to at least partially overlap the end panel when the tray is formed from the blank.

30. The blank of claim 29, wherein the first reinforcement panel is foldably connected to the side panel along a first fold line, the reinforcement flap is foldably connected to the end panel along a second fold line, and the second fold line is generally perpendicular to the first fold line.

31. The blank of claim 29, wherein the end panel is a first end panel, the reinforcement flap is a first reinforcement flap, and the blank further comprises a second end panel foldably connected to the bottom panel and a second reinforcement flap foldably connected to the second end panel, the second reinforcement flap being configured to at least partially overlap the second end panel when the tray is formed from the blank.

32. The blank of claim 24, wherein the side panel is a first side panel, the gusset panel is a first gusset panel, the plurality of panels further comprises a second side panel foldably connected to the bottom panel and disposed opposite to the first side panel, and the blank further comprises a second gusset panel foldably connected to the second side panel, the second gusset panel and the end panel being for to at least partially overlapping one another when the tray is formed from the blank.

33. The blank of claim 32, wherein the first gusset panel comprises a first extension tab, the second gusset panel comprises a second extension tab, and the first extension tab and the second extension tab are configured at least partially overlap one another when the tray is formed from the blank.

34. The blank of claim 32, wherein the first gusset panel comprises a cutout having a first edge and the second gusset panel comprises an extension tab having a second edge, and the extension tab is configured to extend at least partially into the cutout so that the first edge is adjacent the second edge when the tray is formed from the blank.

35. The blank of claim 32, wherein the first gusset panel comprises an emboss portion, the second gusset panel comprises an extension tab, and the emboss portion is configured to at least partially overlap at least a portion of the extension flap when the tray is formed from the blank.

36. The blank of claim 35, wherein the emboss portion at least partially defines a recess, and the extension tab is for being positioned to be at least partially received in the recess when the tray is formed from the blank.

37. The blank of claim 24, wherein the end flap is foldably connected to the bottom panel along an arcuate fold line that is concave with respect to the bottom panel so that at least a portion of the end panel bends outwardly when the tray is formed from the blank.

38. A method for forming a tray for holding a food product, the method comprising:

obtaining a blank comprising a plurality of panels, reinforcing structure features, and a gusset panel foldably connected to the side panel, the plurality of panels comprising a bottom panel, a side panel foldably connected to the bottom panel, and an end panel foldably connected to the bottom panel, the reinforcing structure features comprising a first reinforcement panel foldably connected to at least one panel of the plurality of panels, and a second reinforcement panel foldably connected to the first reinforcement panel, the blank comprising paperboard;

at least partially forming an interior of the tray by positioning the side panel and the end panel with respect to the bottom panel;

positioning the gusset panel and the end panel to at least partially overlap one another; and positioning the reinforcing structure features to form a hollow rim defining an empty space between the first reinforcement panel and the side panel.

39. The method of claim 26 further comprising positioning the second reinforcement panel to at least partially overlap the side panel and the first reinforcement panel to at least partially overlap the second reinforcement panel.

40. The method of claim 39, wherein the first reinforcement flap is foldably connected to the side panel along a fold line, the first reinforcement panel is spaced apart from the side panel at the hollow rim, the second reinforcement panel comprises an edge, and the forming the hollow rim further comprises disposing the edge of the second reinforcement panel to be spaced apart from the fold line.

41. The method of claim 38 further comprises positioning the second reinforcement panel in face-to-face contact with each of the side panel and the first reinforcement panel so that the reinforcing structure comprises three layers of material at an upper portion of the side panel.

42. The method of claim 38, the blank comprises a reinforcement flap foldably connected to the end panel, and the method further comprises positioning the reinforcement flap to at least partially overlap the end panel.

43. The method of claim 42, wherein the end panel is a first end panel, the reinforcement flap is a first reinforcement flap, and the tray further comprises a second end panel foldably connected to the bottom panel and a second reinforcement flap foldably connected to the second end panel, and the method further comprises positioning the second reinforcement flap to at least partially overlap the second end panel.

44. The method of claim 38, wherein the side panel is a first side panel, the gusset panel is a first gusset panel, the plurality of panels further comprising a second side panel foldably connected to the bottom panel and disposed opposite to the first side panel, and the blank further comprises a second gusset panel foldably connected to the second side panel, the method further comprising positioning the second gusset panel and the end panel to at least partially overlap one another.

45. The method of claim 44, wherein the first gusset panel comprises a first extension tab, the second gusset panel comprises a second extension tab, and the method further comprises positioning the first extension tab and the second extension tab to at least partially overlap one another.

46. The method of claim 44, wherein the first gusset panel comprises a cutout having a first edge and the second gusset panel comprises an extension tab having a second edge, and the method further comprises at least partially receiving the extension tab in the cutout so that the first edge is adjacent the second edge.

47. The method of claim 44, wherein the first gusset panel comprises an emboss portion, the second gusset panel comprises an extension tab, the emboss portion at least partially defines a recess, and the method further comprises positioning the emboss portion to at least partially overlap at least a portion of the extension flap and positioning the recess to at least partially receive the extension tab.

* * * * *